US010811819B2

(12) United States Patent
Azad et al.

(10) Patent No.: US 10,811,819 B2
(45) Date of Patent: Oct. 20, 2020

(54) ELECTRICAL CONNECTOR WITH CPA

(71) Applicant: J.S.T. CORPORATION, Farmington Hills, MI (US)

(72) Inventors: Vikas Azad, Novi, MI (US); Ping Chen, Farmington Hills, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 16/298,259

(22) Filed: Mar. 11, 2019

(65) Prior Publication Data

US 2019/0280429 A1 Sep. 12, 2019

Related U.S. Application Data

(60) Provisional application No. 62/641,601, filed on Mar. 12, 2018.

(51) Int. Cl.

| | |
|---|---|
| ***H01R 4/50*** | (2006.01) |
| ***H01R 13/627*** | (2006.01) |
| ***H01R 13/436*** | (2006.01) |
| ***H01R 13/64*** | (2006.01) |
| ***H01R 13/639*** | (2006.01) |
| ***H01R 13/502*** | (2006.01) |
| ***H01R 13/641*** | (2006.01) |
| ***H01R 43/18*** | (2006.01) |

(52) U.S. Cl.

CPC ..... *H01R 13/6272* (2013.01); *H01R 13/4361* (2013.01); *H01R 13/5025* (2013.01); *H01R 13/639* (2013.01); *H01R 13/64* (2013.01); *H01R 13/641* (2013.01); *H01R 43/18* (2013.01)

(58) Field of Classification Search

CPC ..... H01R 13/627; H01R 13/6272; H01R 13/4361; H01R 13/5025; H01R 13/639; H01R 13/64; H01R 13/641; H01R 43/18

USPC ..... 439/345, 352, 357, 372

See application file for complete search history.

(56) References Cited

U.S. PATENT DOCUMENTS

| | | | |
|---|---|---|---|
| 6,261,116 | B1 | 7/2001 | Ceru |
| 6,273,729 | B1 | 8/2001 | Kelly |
| 7,326,074 | B1 | 2/2008 | Lim |
| 8,016,606 | B1 | 9/2011 | Kwan |
| 2002/0086575 | A1 | 7/2002 | Marpoe |
| 2005/0176295 | A1 | 8/2005 | Morita |
| 2017/0062982 | A1 | 3/2017 | Holub |
| 2017/0207575 | A1 | 7/2017 | Jabrane |

OTHER PUBLICATIONS

International Search Report of the International Searching Authority for International Application No. PCT/US19/21630 dated May 24, 2019 (2 sheets).

International Search Report of the International Searching Authority for International Application No. PCT/US2019/021788 dated May 16, 2019 (2 pages).

International Preliminary Report on Patentability for International Application No. PCT/US2019/021630 dated Dec. 10, 2019 (15 sheets).

*Primary Examiner* — Khiem M Nguyen

(74) *Attorney, Agent, or Firm* — Kratz, Quintos & Hanson, LLP

(57) ABSTRACT

Electrical connector with low profile connector position assurance (CPA) member for assuring the engagement of a female housing with a male housing. The female housing forms apertures designed to stably and securely receive the low profile CPA member. Also, the female housing includes a connector latch used to securely hold together the female housing and the male housing.

20 Claims, 30 Drawing Sheets

ELECTRICAL CONNECTOR WITH CPA

CROSS-REFERENCE TO RELATED APPLICATIONS

This patent application claims priority to U.S. Provisional Patent Application No. 62/641,601, filed Mar. 12, 2018, which is hereby incorporated herein by reference in its entirety.

BACKGROUND OF THE INVENTION

The present invention generally relates to an electrical connector apparatus having a female housing, a connector position assurance (CPA) member, and a male housing.

BRIEF SUMMARY OF THE INVENTION

The present invention generally relates to an electrical connector apparatus having a female connector assembly and a male connector assembly. The female connector assembly includes at least a female housing and a highly effective connector position assurance (CPA) member. The male connector assembly includes at least a male housing. The female connector assembly and male connector assembly can be mated together.

The CPA member of the present invention provides a benefit by assuring the engagement of the male housing with the female housing. The female housing further includes a connector latch used to securely hold the electrical connector apparatus together. A terminal position assurance (TPA) member can be inserted into the female housing for assuring that terminals for the electrical connector apparatus are positioned properly.

An electrical connector apparatus, having the female housing of the present invention, a male housing, the CPA member of the present invention, and the connector latch of the present invention, demonstrates a number of desirable characteristics. For example, one of the desirable characteristics is that the CPA member and female housing of the present invention can be used with existing male housings without requiring changes to the male inline and/or header.

Also, one of the desirable characteristics is that the CPA member and female housing of the present invention can be used with existing male housings without requiring changes to the overall shape of the male housings.

There are some existing male housings that do not currently have the benefit of a highly effective CPA member. That is, those existing male housings do not have a configuration that accommodates a highly effective CPA member. Thus, those existing male housings do not have the beneficial assurance of the engagement of the male housing with a female housing provided by a highly effective CPA member.

According to the principles of the present invention as disclosed herein, at least some internal aspects of a female housing have been modified in order to accommodate a highly effective CPA member, while at least some external aspects of the female housing have not been modified. Because of the external aspects of the female housing which were not modified, the female housing of the present invention and the highly effective CPA member of the present invention can be used with an existing male housing. Thus, the existing male housing does not need to be modified extensively if at all, and the existing male housing can be used with the female housing of the present invention and the CPA member of the present invention. This is advantageous because existing male housings that previously were not being used with a highly effective CPA member can now have the benefits of being used with such a CPA member.

The female housing of the present invention has been specially designed and made to have a shape that fits well with existing male housings while also having features, such as apertures and/or slots, that can accommodate a highly effective CPA member.

The CPA member of the present invention is highly effective, and has been specially designed and made to have the shape and features that fit well with the female housing of the present invention and the existing male housings discussed above.

Other desirable characteristics of the present invention are as follows: there is an audible "click" sound when the female connector assembly and the male housing are mated together, which is an extra loud sound; a low profile connector position assurance (CPA) member; a low profile connector latch; a resistance to permanent set for the connector latch; a resistance to movement to final lock position for the CPA member; a moderate amount of reinforcement; mutual retention; good mechanical strength; easy molding features; no secondary operation of a user is required; failure prevention means; and good dimensional control of latching geometry.

To ensure that the CPA member is made available for connecting to the female housing during transport thereof, for example, the CPA member is engaged, in a preset position, to the female housing.

The male housing and female connector assembly are engaged together, and the engagement thereof is assured, when the CPA member is placed in a final lock position.

It is a desirable trait to have an audible "click" sound for an electrical connector. For example, when components of an automotive electrical connector are completely mated with each other, it is a desirable trait to have an audible "click" sound for convenient assurance that the components are completely mated. In the automotive connector field, an extra loud sound is favorable. The "click" sound can be achieved by an interaction of latching features, for example. By placing latching features in a preloaded condition, there is additional force when a first connector assembly and a second housing are mated together, and that additional force helps to make the "click" sound louder than it would have been if the latching features had not been in a preloaded condition.

It is a desirable trait for the connector latch to have a low profile. By manufacturing the connector latch in an undeflected position, the gaps required to create overstress protection features, to prevent the connector latch from being pried in the wrong direction and damaged, are not needed. The gaps can be removed from the overall height of the latch system, so that the connector latch can have a low profile.

It is a desirable trait to have a resistance to being set. For example, when automotive wire harnesses are bundled for shipment, the connector latches can be unintentionally compressed and held in a deflected position. Especially in hot environments, this condition causes the connector latch to be permanently deflected, also known as permanently set, thus rendering the connector latch useless or less effective. Preloading the connector latch makes the connector latch more resistant to this failure mode.

It is a desirable trait to have good dimensional control of latching geometry. By preloading the connector latch against dimensionally stable features, the height of the connector latch features can be controlled easily.

After the connector latch is manufactured, the connector latch is in an undeflected position. The connector latch is then subjected to a pre-mating deflection process, in order to deflect the connector latch and lock the connector latch in a preloaded position. After the pre-mating deflection process has been completed, the connector latch is locked in a preloaded position and can be referred to as a preloaded connector latch.

When a first connector assembly and a second housing are engaged together, the engagement thereof is assured because the connector latch causes an audible "click" sound. A first connector assembly can be referred to as a connector, and can include at least a first housing and a connector position assurance member, for example. A first connector assembly can correspond to a female connector assembly or other type of connector assembly, for example. A first housing can correspond to a female housing or other type of housing, for example. A second housing can correspond to a male housing or other type of housing, for example. The undeflected position can also be referred to as an extended and relaxed undeflected position.

A CPA member provides a number of desirable characteristics, including at least, for example: it helps to achieve a full potential force of the system and desirable audible "click" sound when the CPA member is inserted into a housing; it helps to avoid a CPA member being moved to a final lock position (or "set" position) during shipping and/or handling; it requires no secondary operation of a user; and it helps prevent failure.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanations without limiting the scope of the invention as claimed.

DETAILED DESCRIPTION OF THE PREFERRED EMBODIMENTS

Figure 1:
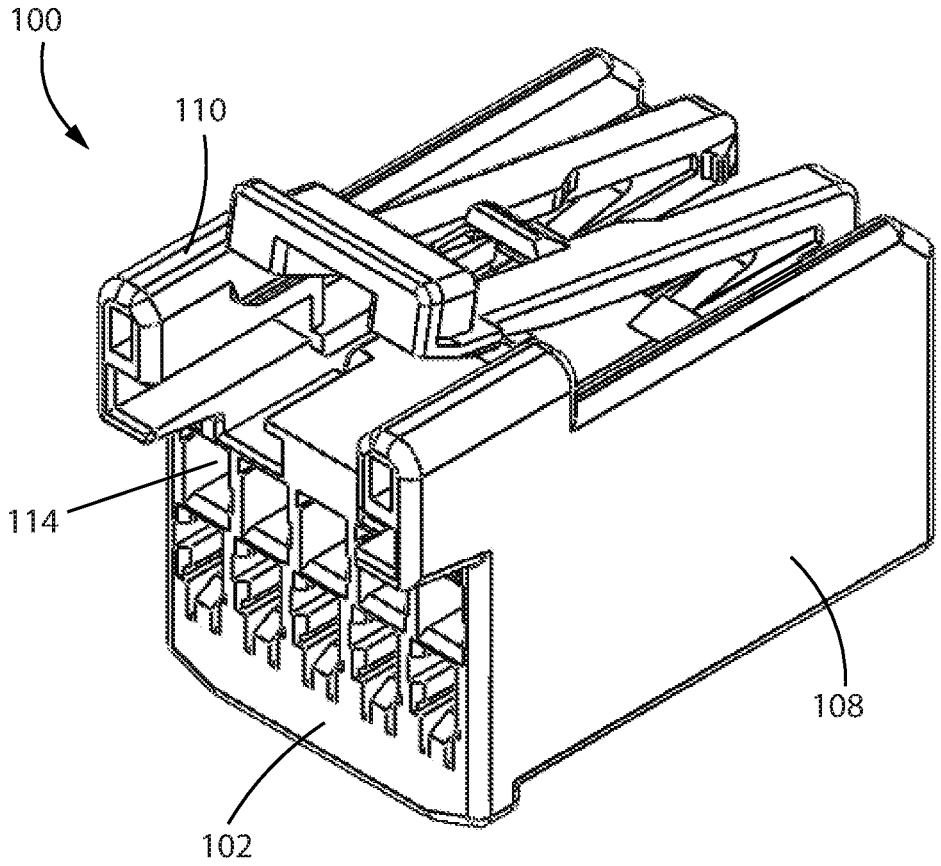
FIG. 1 is a perspective view of a female housing, in accordance with the principles of the present invention.

FIG. 1 is a perspective view of a female housing, in accordance with the principles of the present invention. FIG. 1 illustrates that a female housing 100 has a front end 102, a second side 108, a top 110, at least one terminal aperture 114 at the front end 102.

The present invention generally relates to an electrical connector apparatus having a female connector assembly and a male connector assembly. The female connector assembly includes at least a female housing and a connector position assurance (CPA) member. The male connector assembly includes at least a male housing. The female connector assembly and male connector assembly can be mated together.

Figure 2:
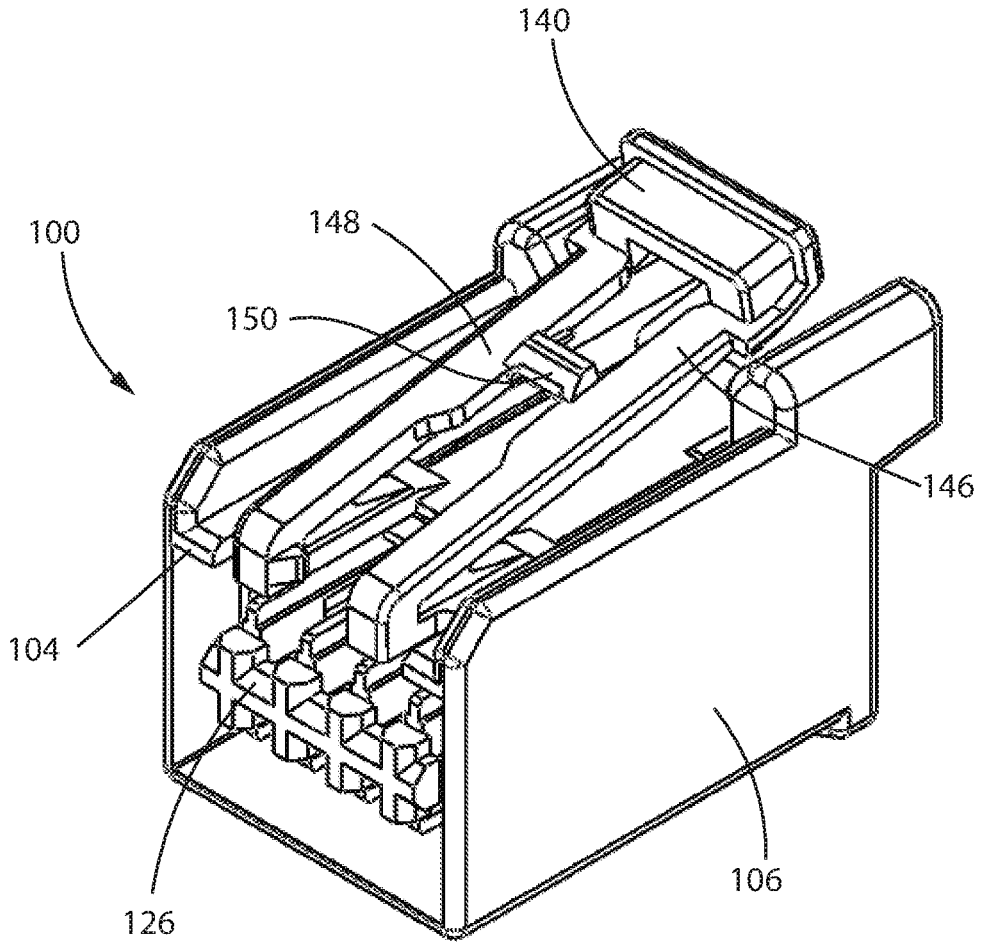
FIG. 2 is a perspective view of the female housing of FIG. 1.

FIG. 2 is a perspective view of the female housing of FIG. 1. FIG. 2 illustrates that the female housing 100 has a rear end 104, a first side 106, at least one terminal aperture 126 at the rear end, a button 140 of a connector latch, a first latch beam 146 of the connector latch, a second latch beam 148 of the connector latch, and a latch surface 150 of the connector latch.

Figure 3:
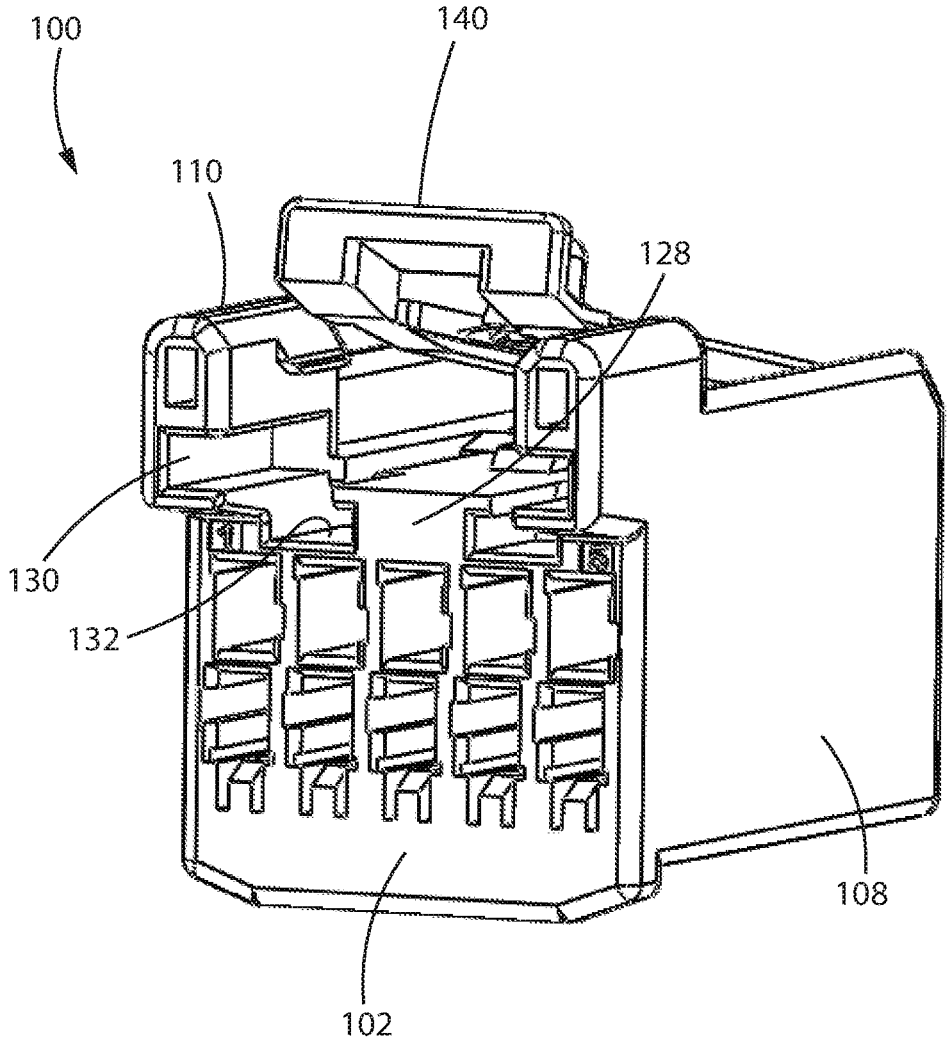
FIG. 3 is a perspective view of the female housing of FIG. 1.

FIG. 3 is a perspective view of the female housing of FIG. 1. FIG. 3 illustrates that the female housing 100 has a "T" shaped guide member 128, an upper aperture 130 (near the first side 106) for receiving a portion of a CPA member 200, and a lower aperture 132 (near the first side 106) for receiving a portion of the CPA member 200.

The highly effective CPA member 200 provides a benefit by assuring the engagement of a male housing 400 with the female housing 100. The female housing 100 further includes a connector latch used to securely hold the electrical connector apparatus together. A terminal position assurance (TPA) member 300 can be inserted into the female housing for assuring that terminals for the electrical connector apparatus are positioned properly, but the TPA member 300 is not required.

An electrical connector apparatus, having the female housing 100 of the present invention, a male housing 400, the CPA member 200 of the present invention, and the connector latch of the present invention, has a number of desirable characteristics. For example, one of the desirable characteristics is that the CPA member and female housing of the present invention can be used with existing male housings without requiring changes to the male inline and/or header.

Also, one of the desirable characteristics is that the CPA member and female housing of the present invention can be used with existing male housings without requiring changes to the overall shape of the male housings.

There are some existing male housings that do not currently have the benefit of a highly effective CPA member. That is, those existing male housings do not have a configuration that accommodates a highly effective CPA member. Thus, those existing male housings do not have the beneficial assurance of the engagement of the male housing with a female housing provided by a highly effective CPA member.

According to the principles of the present invention as disclosed herein, at least some internal aspects of a female housing have been modified in order to accommodate a highly effective CPA member, while at least some external aspects of the female housing have not been modified. Because of the external aspects of the female housing which were not modified, the female housing of the present invention and the highly effective CPA member of the present invention can be used with an existing male housing. Thus, the existing male housing does not need to be modified extensively if at all, and the existing male housing can be used with the female housing of the present invention and the CPA member of the present invention. This is advantageous because existing male housings that previously were not being used with a highly effective CPA member can now have the benefits of being used with such a CPA member.

The female housing of the present invention has been specially designed and made to have a shape that fits well with existing male housings while also having features, such as apertures and/or slots, that can accommodate a highly effective CPA member.

The CPA member of the present invention is highly effective, and has been specially designed and made to have the shape and features that fit well with the female housing of the present invention and the existing male housings discussed above.

A full connector assembly can include a male connector assembly and a female connector assembly, for example. The male connector assembly can include a male housing and may also include one or more terminal position assurance (TPA) members and/or one or more connector position assurance (CPA) members. The female connector assembly can include a female housing and may also include one or more terminal position assurance members and/or one or more connector position assurance members.

For example, a female connector assembly may consist of a female housing, an optional TPA member, and a CPA member. In this example, the TPA member and CPA member are inserted into the female housing in the preset position, for a female sub-assembly. Then, the female sub-assembly is inserted into a male housing.

A male connector assembly, for example, may consist of a male housing and an optional TPA member. In this example, for a male sub-assembly, the optional TPA member is inserted into the male housing in the preset position.

The female and male connector assemblies are generally assembled separately. After inserting terminals in both the female and male connector assemblies, a TPA member can be pushed to the final lock position for providing a secondary locking to the terminals. Both sub-assemblies are then mated to make a full connector assembly.

The female housing has a connector latch which latches with the male housing to interlock. The CPA member provides an assurance that both female and male connector assemblies are locked.

Preliminarily, the CPA member is placed in the female housing in a preset position. Then, when appropriate, the CPA member is pushed to the final lock position (fully locked position, "set" position).

The electrical connector with CPA of the present invention includes a number of advantages and improvements. The electrical connector with CPA of the present invention can help to prevent a locking latch from getting damaged/deformed during shipping and handling, and thus can help prevent mating problems.

The electrical connector with CPA of the present invention can help to prevent a CPA member from getting damaged/deformed during shipping and handling, and thus can help prevent mating problems.

The electrical connector with CPA of the present invention can help to prevent a user from needing to engage in secondary operations.

The electrical connector with CPA of the present invention can help to prevent complaints from a user, because it helps prevent problems associated with an inadvertent movement of a CPA member to a final lock position during shipping and/or handling, for example.

The electrical connector with CPA of the present invention provides an improved connector assembly comprising a female housing and a CPA member designed to provide a superior audible click sound, moderate reinforcement, mutual retention, good mechanical strength when the female and male housings engage with each other, and extremely easy molding consideration by manufacturing the female housing's connector latch with overbuild and then pushing the button of the connector latch to a preset position during assembly.

After the electrical connector with CPA of the present invention is manufactured, the connector latch is in the extended and relaxed undeflected position. When the connector latch is in that position, the button 140 of the connector latch is extended upward, above a top 110 of a female housing 100. The button 140 is held up in the extended and relaxed undeflected position by the latch beams 146 and 148.

As indicated above, after the electrical connector with CPA of the present invention is manufactured, the connector latch is in the extended and relaxed undeflected position. The connector latch is then subjected to a pre-mating deflection process, in order to deflect the connector latch and lock the connector latch in a preloaded position.

The pre-mating deflection process for the connector latch can include urging the button 140 downward toward the "T" shaped guide member 128.

After the pre-mating deflection process has been completed, the connector latch is locked in a preloaded position and can be referred to as a preloaded connector latch.

FIGS. 1-4, for example, show a female housing 100 having a connector latch in accordance with the principles of the present invention, showing the connector latch in an extended and relaxed undeflected position.

Figure 7:
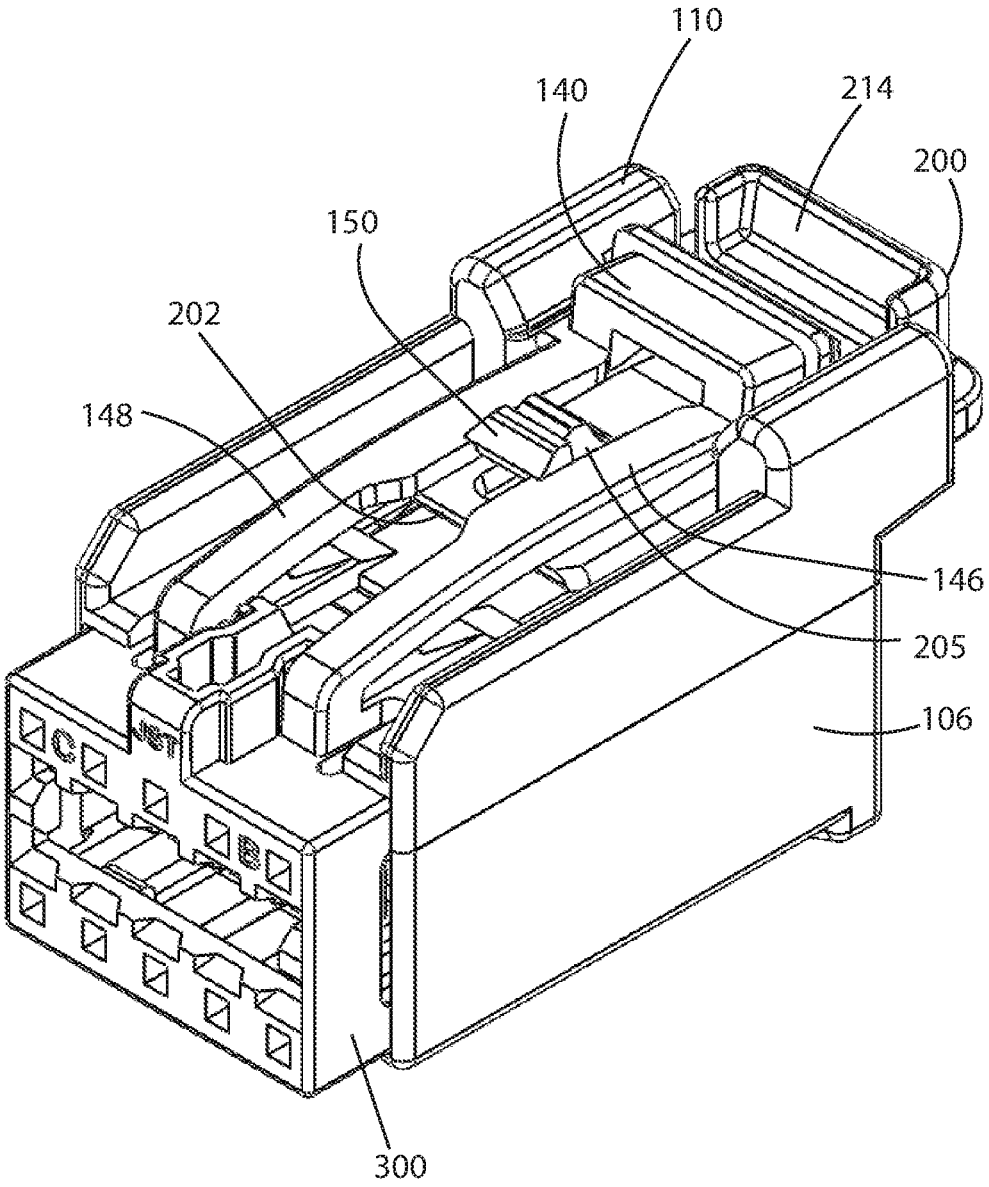
FIG. 7 is a perspective view of the female housing of FIG. 1, with a TPA member and a CPA member.
Figure 8A:
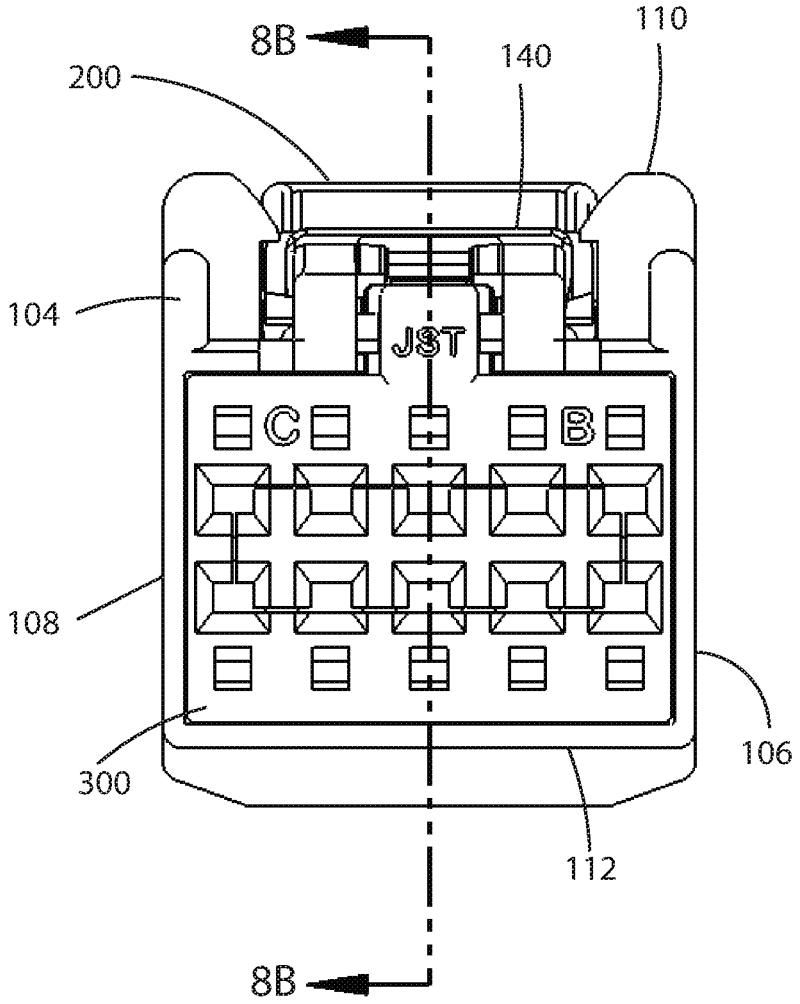
FIG. 8A is a rear end elevational view of the female housing of FIG. 1, with a TPA member and a CPA member.
Figure 8B:
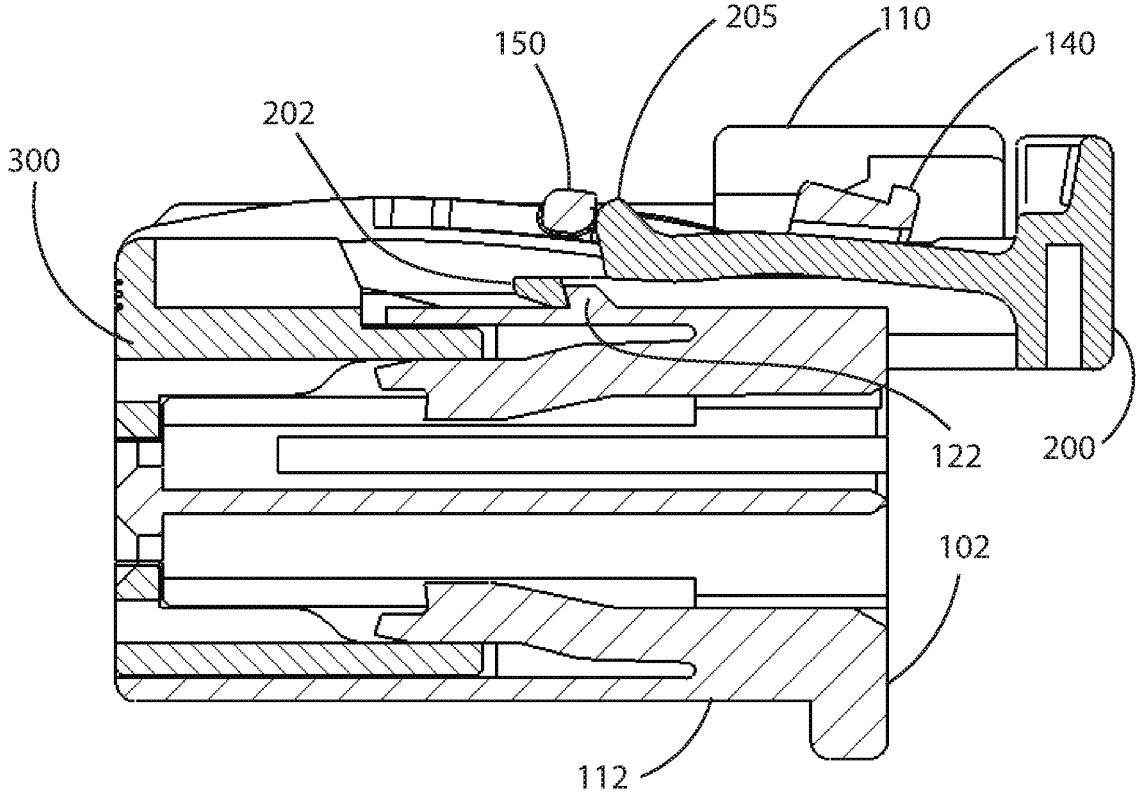
FIG. 8B is a cross-sectional view of the female housing of FIG. 8A, taken along line 8B-8B.

FIGS. 7, 8A, and 8B, for example, show a female housing 100 having a connector latch in accordance with the principles of the present invention, showing the connector latch locked in a preloaded position. FIGS. 7, 8A, and 8B, for example, also show a CPA member 200 in a preset position.

Figure 4:
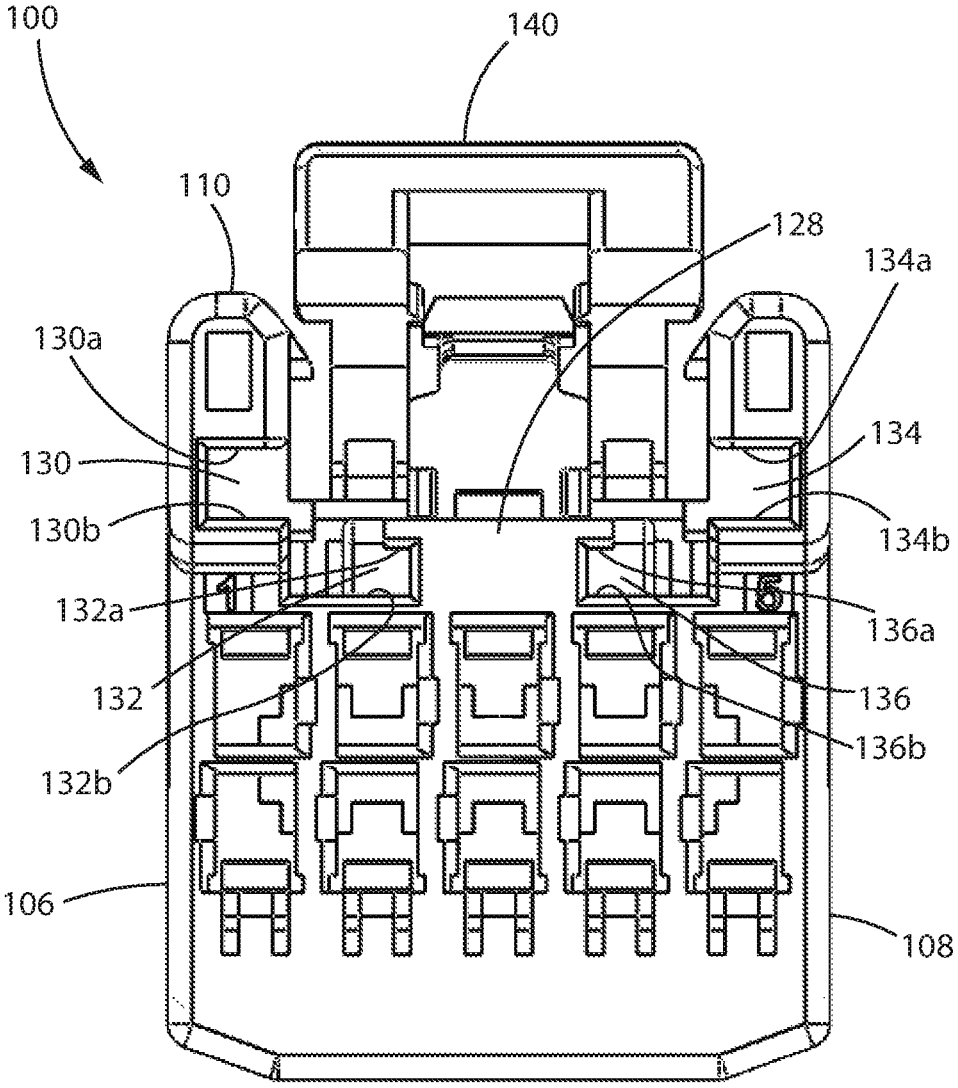
FIG. 4 is a front end elevational view of the female housing of FIG. 1.

FIG. 4 is a front end elevational view of the female housing of FIG. 1. FIG. 4 illustrates that the female housing 100 has an upper aperture 134 (near the second side 108) for receiving a portion of the CPA member 200, and also has a lower aperture 136 (near the second side 108) for receiving a portion of the CPA member 200.

FIG. 4 shows that the upper aperture 130 has an upper wall 130*a* and a lower wall 130*b*, the lower aperture 132 has an upper wall 132*a* and a lower wall 132*b*, the upper aperture 134 has an upper wall 134*a* and a lower wall 134*b*, the lower aperture 136 has an upper wall 136*a* and a lower wall 136*b*.

Figure 5A:
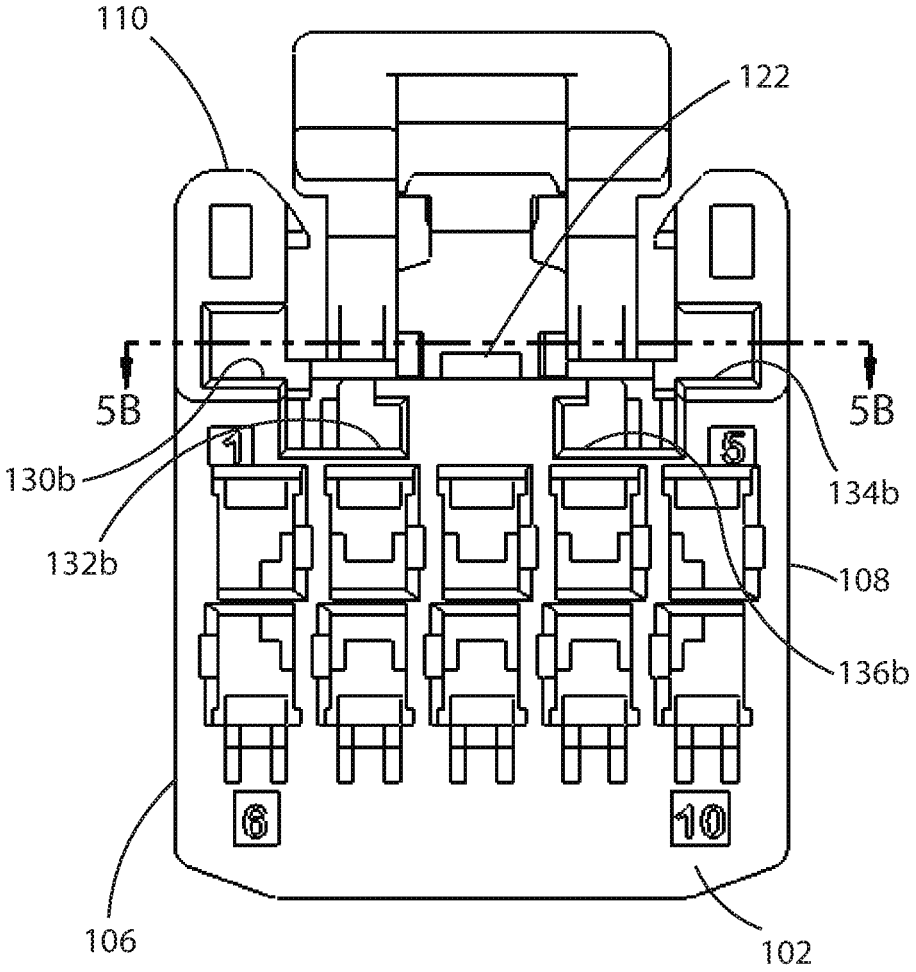
FIG. 5A is a front end elevational view of the female housing of FIG. 1.
Figure 5B:
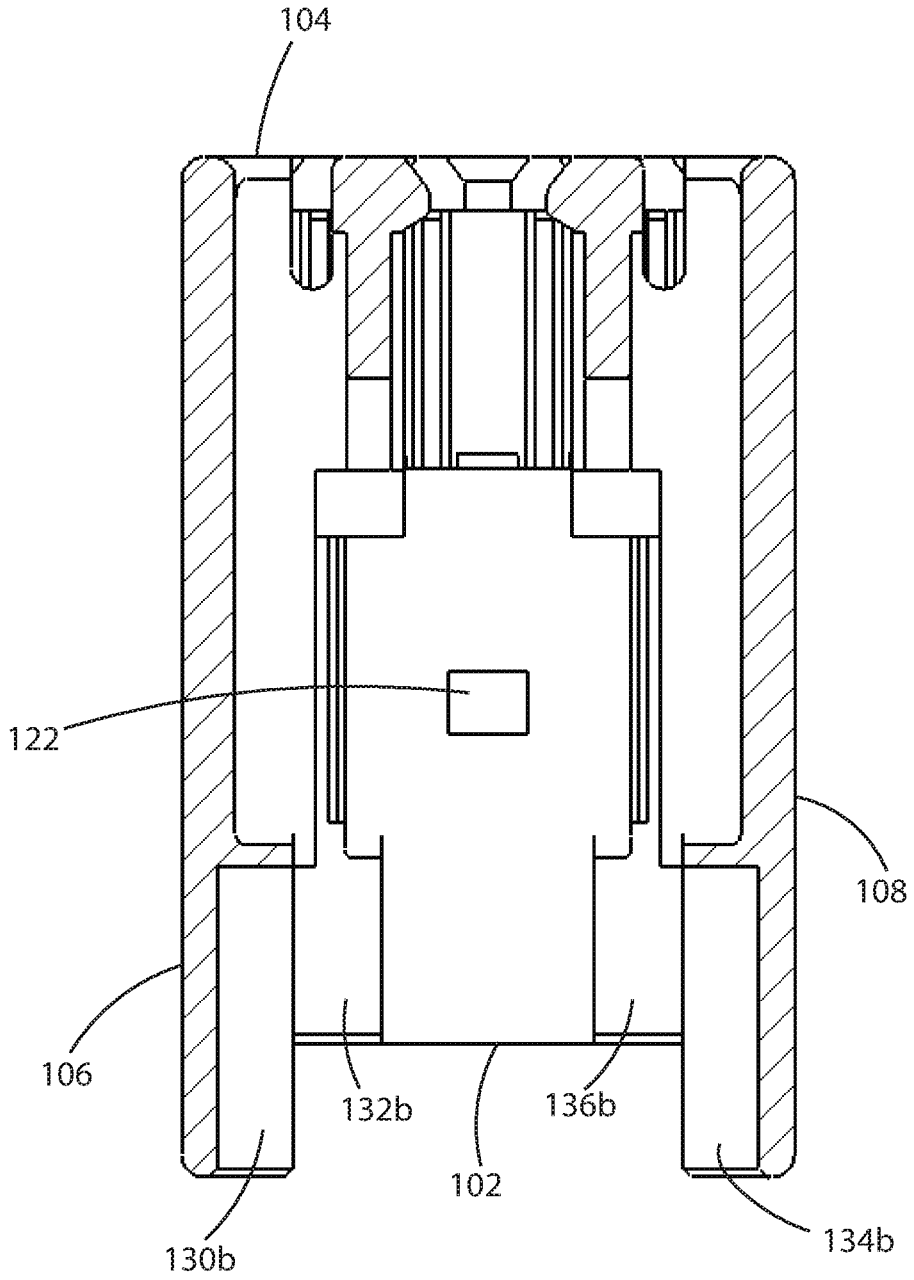
FIG. 5B is a cross-sectional view of the female housing of FIG. 5A, taken along line 5B-5B.
Figure 5C:
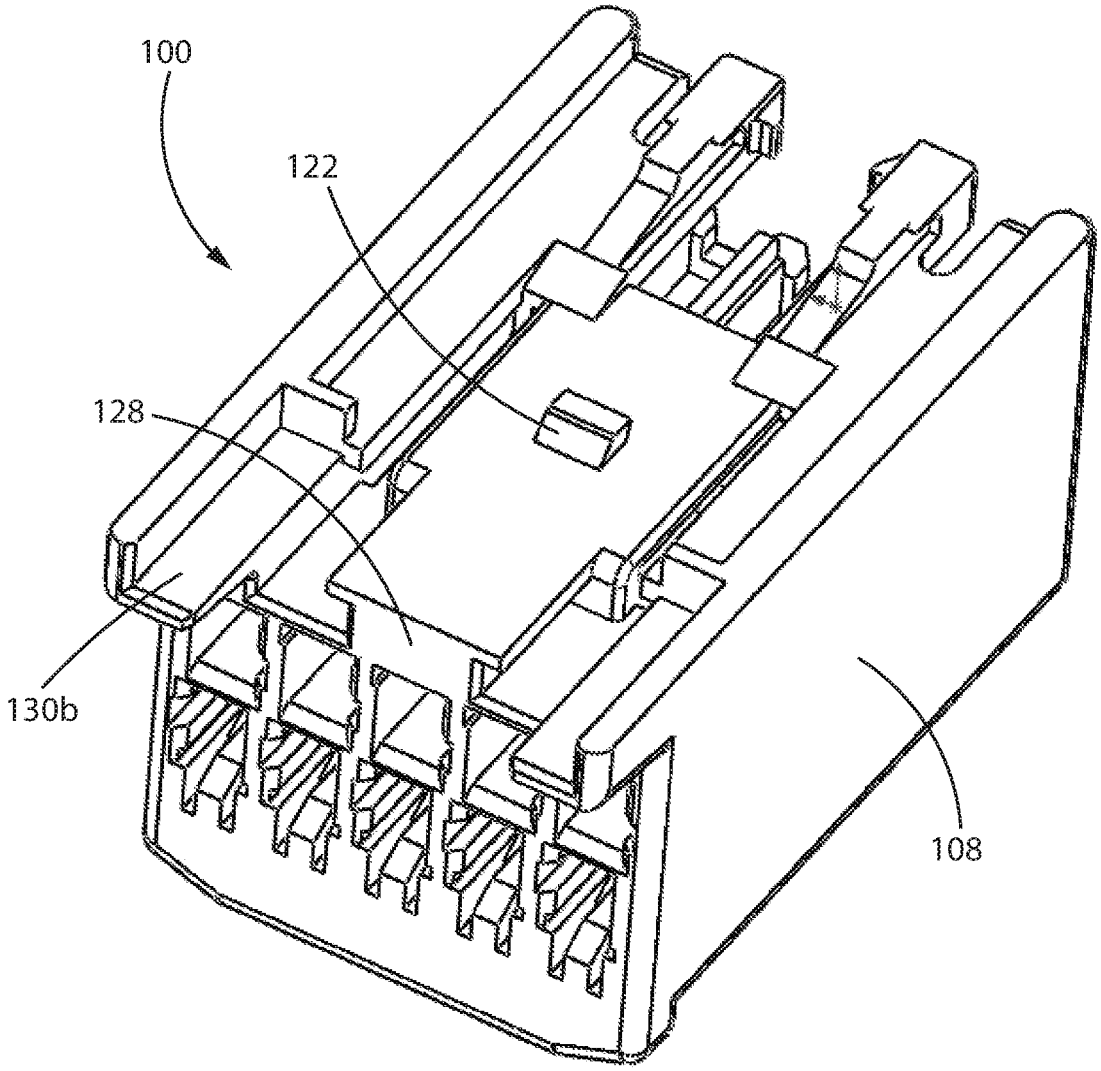
FIG. 5C is a perspective view of the female housing of FIG. 5A, taken along line 5B-5B.

FIG. 5A is a front end elevational view of the female housing of FIG. 1. FIG. 5 illustrates that there is a protrusion 122 on an interior of the female housing 100. FIG. 5B is a cross-sectional view of the female housing of FIG. 5A, taken along line 5B-5B. FIG. 5C is a perspective view of the female housing of FIG. 5A, taken along line 5B-5B.

Figure 6A:
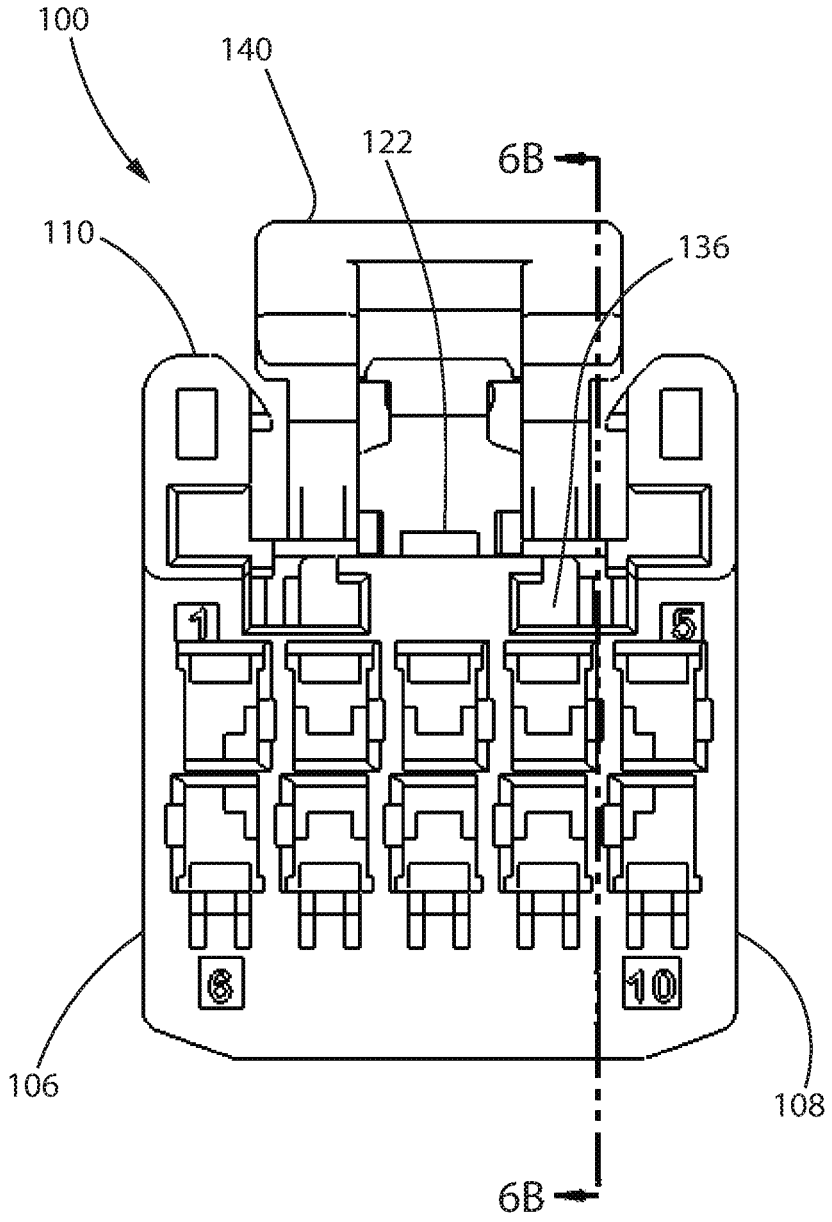
FIG. 6A is a front end elevational view of the female housing of FIG. 1.
Figure 6B:
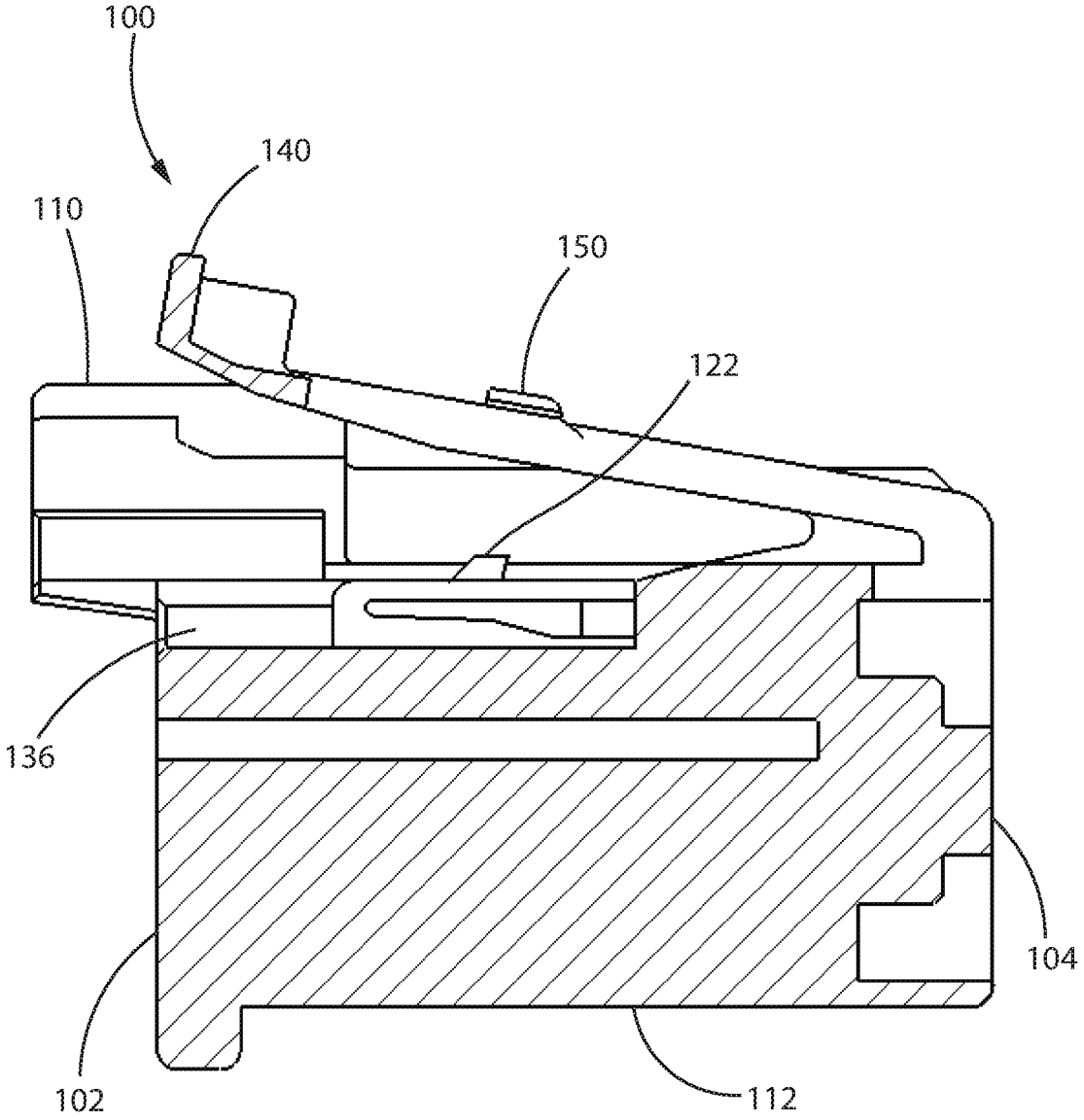
FIG. 6B is a cross-sectional view of the female housing of FIG. 6A, taken along line 6B-6B.
Figure 6C:
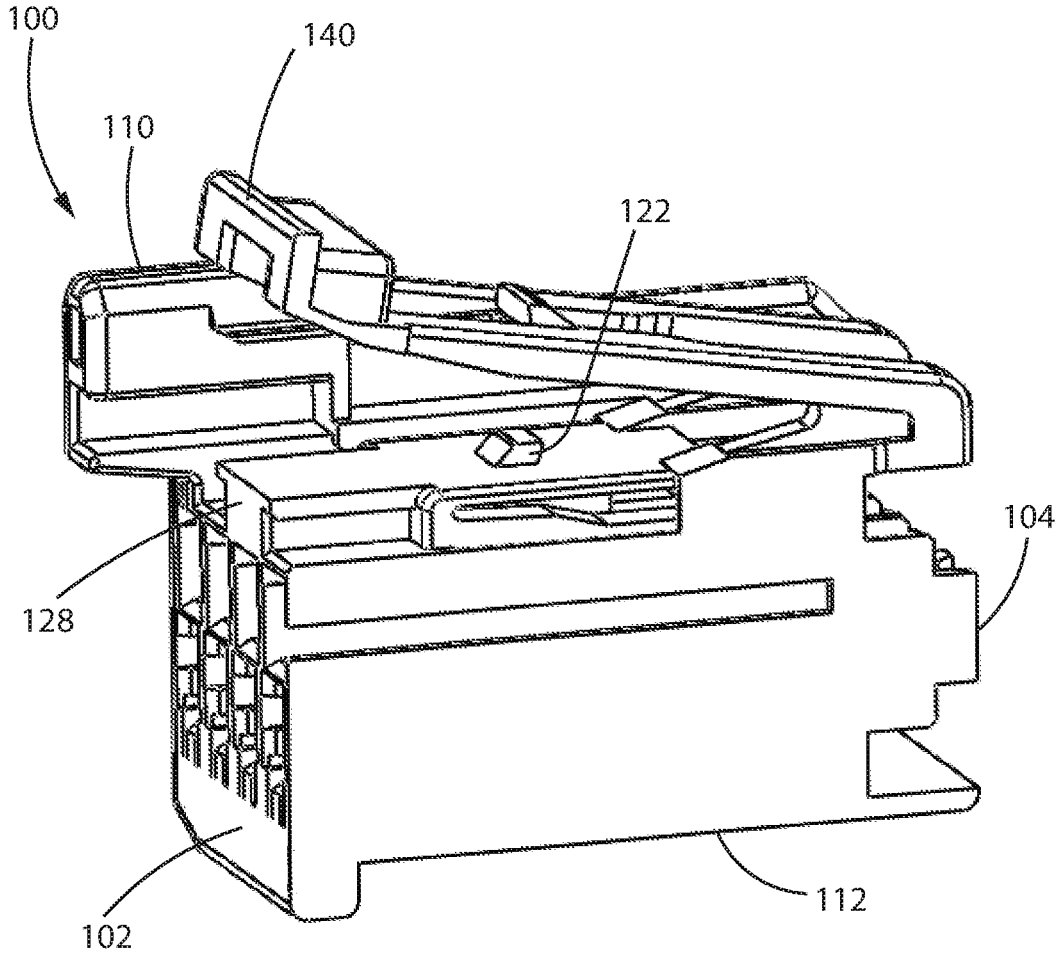
FIG. 6C is a perspective view of the female housing of FIG. 6A, taken along line 6B-6B.

FIG. 6A is a front end elevational view of the female housing of FIG. 1. FIG. 6B is a cross-sectional view of the female housing of FIG. 6A, taken along line 6B-6B. FIG. 6B illustrates that the female housing 200 has a bottom 112. FIG. 6C is a perspective view of the female housing of FIG. 6A, taken along line 6B-6B.

FIG. 7 is a perspective view of the female housing of FIG. 1, with a terminal position assurance (TPA) member and a connector position assurance (CPA) member. FIG. 7 shows a TPA member 300 inserted in a rear end 104 of the female housing 100.

FIG. 7 shows the CPA member 200 inserted in a front end 102 of the female housing 100. The CPA member 200 is shown in a preset position. FIG. 7 shows a front edge 202 of the CPA member 200, a front tip 205 of a central beam of the CPA member 200, and a rear upright portion 214 of the CPA member 200.

As shown in FIG. 7, which depicts the CPA member 200 in the preset position, the front tip 205 is disposed between the latch surface 150 of the connector latch and the button 140 of the connector latch.

FIG. 8A is a rear end elevational view of the female housing of FIG. 1, with a TPA member and a CPA member. FIG. 8B is a cross-sectional view of the female housing of FIG. 8A, taken along line 8B-8B. FIG. 8B depicts the CPA member 200 in the preset position. FIG. 8B shows that the front tip 205 of the CPA member 200 is disposed between the latch surface 150 of the connector latch and the button 140 of the connector latch.

As shown in FIG. 8B, the front tip 205 of the CPA member 200 is engaging with the latch surface 150. FIG. 8B depicts the situation where the CPA member 200 has been partially inserted into the front end 102 of the female housing 100, to the preset position. FIG. 8B does not depict the situation where the CPA member 200 has been fully inserted into the front end 102 of the female housing 100, to the fully locked position ("set" position).

In the preset position, as shown in FIG. 8B, the latch surface 150 of the female housing 100 engages with the front tip 205 of the CPA member 200, and thereby prevents the CPA member 200 from easily moving further into the female housing 100. Also, in the preset position, as shown in FIG. 8B, the protrusion 122 of the female housing 100 engages with the front edge 202 of the CPA member 200, and thereby prevents the CPA member 200 from easily moving out from the female housing 100.

Figure 9A:
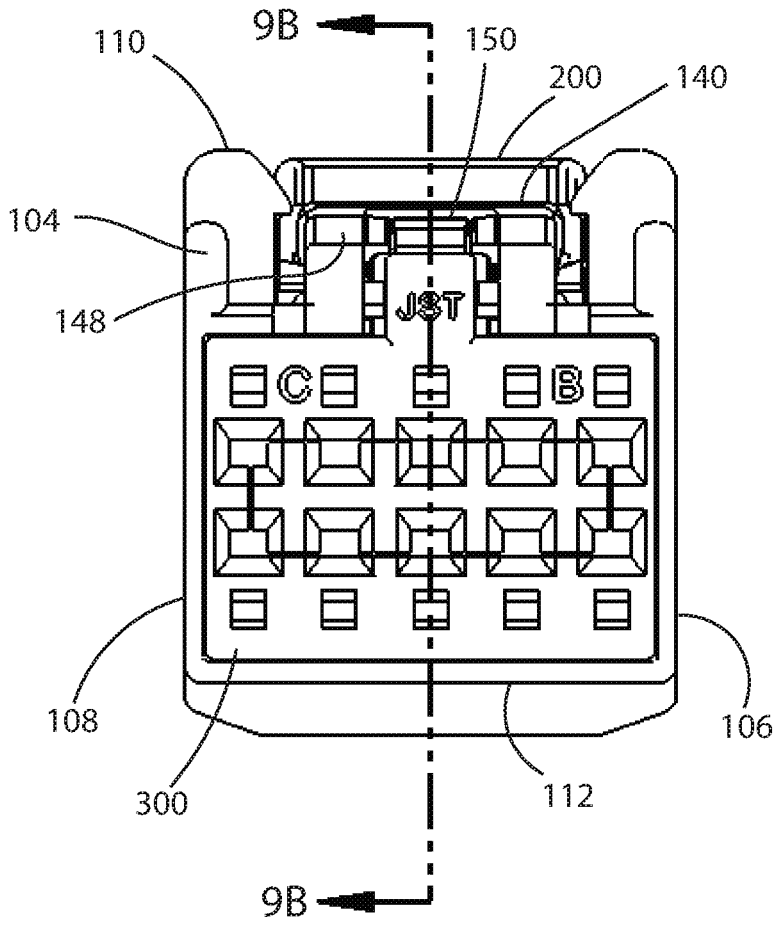
FIG. 9A is a rear end elevational view of the female housing of FIG. 1, with a TPA member and a CPA member.
Figure 9B:
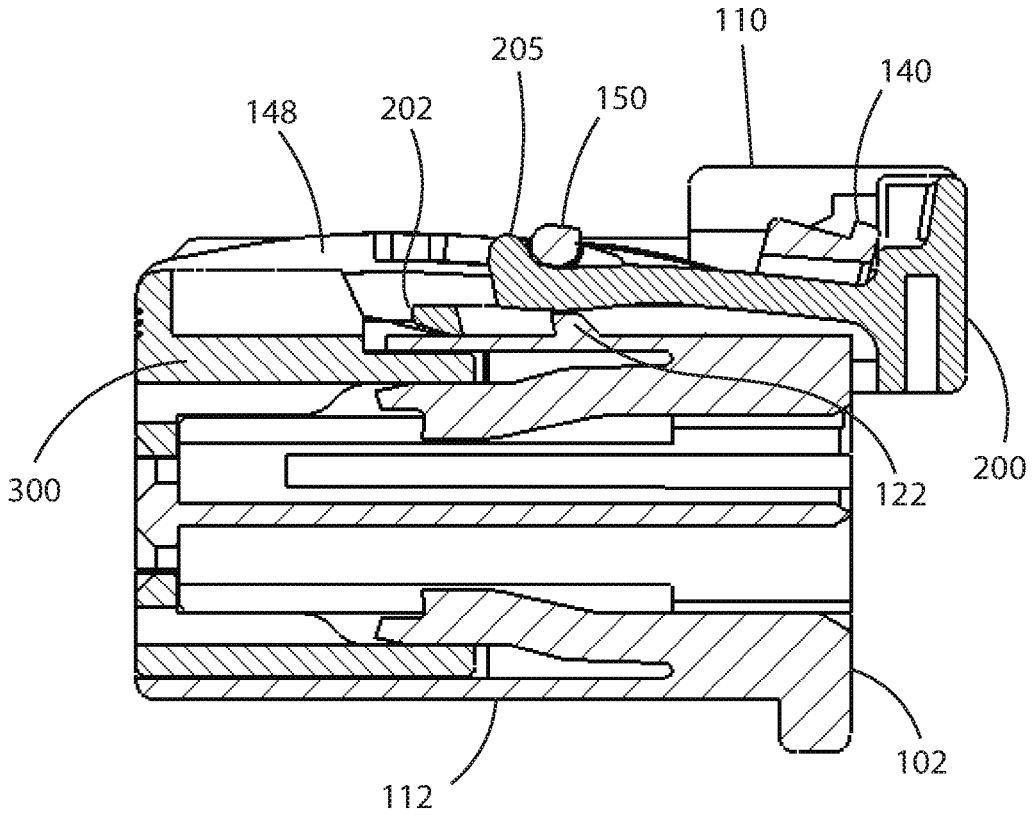
FIG. 9B is a cross-sectional view of the female housing of FIG. 9A, taken along line 9B-9B.

FIG. 9A is a rear end elevational view of the female housing of FIG. 1, with a TPA member and a CPA member. FIG. 9B is a cross-sectional view of the female housing of FIG. 9A, taken along line 9B-9B.

FIG. 9B depicts the CPA member 200 in the fully locked position ("set" position). FIG. 9B shows that the latch surface 150 of the connector latch is disposed between the front tip 205 of the CPA member 200 and the button 140 of the connector latch.

As shown in FIG. 9B, the front tip 205 of the CPA member 200 is engaging with the latch surface 150. FIG. 9B depicts the situation where the CPA member 200 has been fully inserted into the front end 102 of the female housing 100, to the fully locked position ("set" position).

In the fully locked position, as shown in FIG. 9B, the latch surface 150 of the female housing 100 engages with a side of the front tip 205 of the CPA member 200, and thereby prevents the CPA member 200 from easily moving out from the female housing 100.

Also, in the fully locked position, as shown in FIG. 9B, the protrusion 122 of the female housing 100 engages with the bottom of the front tip 205 of the CPA member 200, and thereby prevents the front tip 205 from easily moving downward. Because the front tip 205 is prevented from easily moving downward, this means that the front tip 205 cannot easily get under the latch surface 150. In this way, the CPA member 200 is prevented from easily moving out from the female housing 100.

Figure 10A:
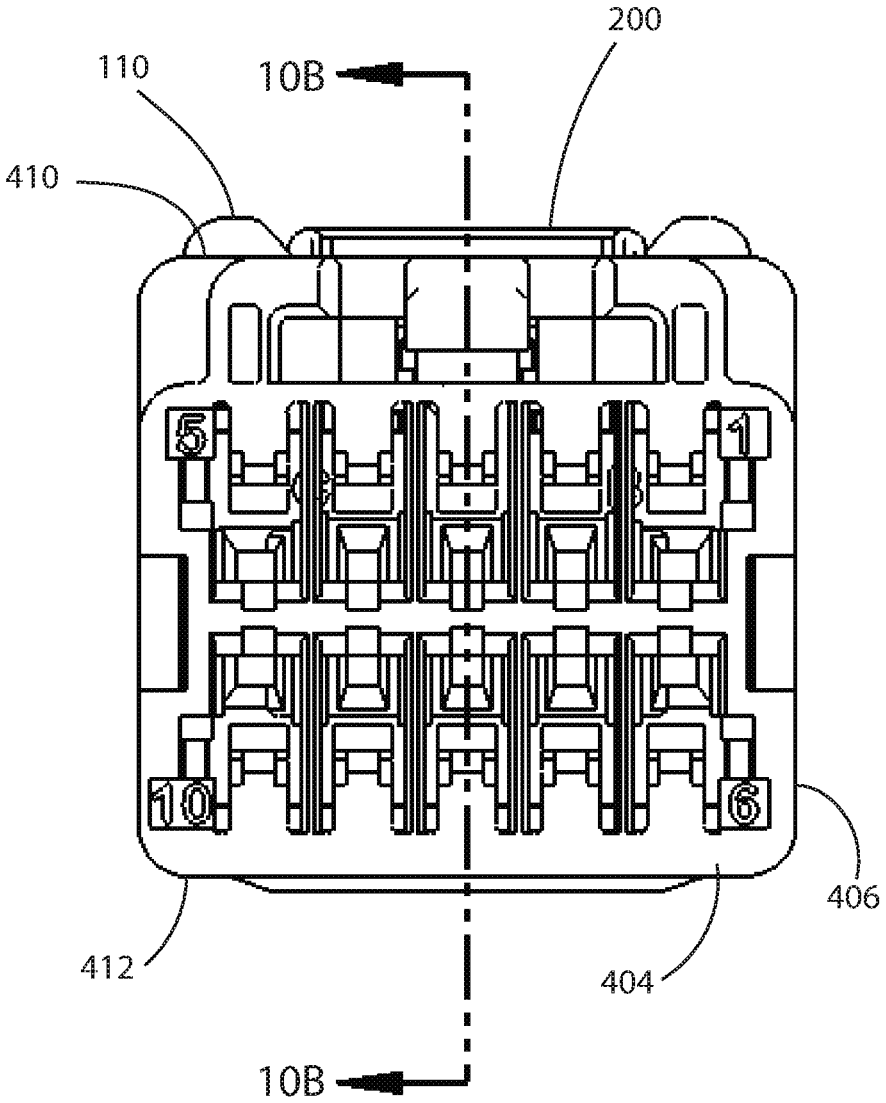
FIG. 10A is a rear end elevational view of the female housing of FIG. 1, with a male housing.
Figure 10B:
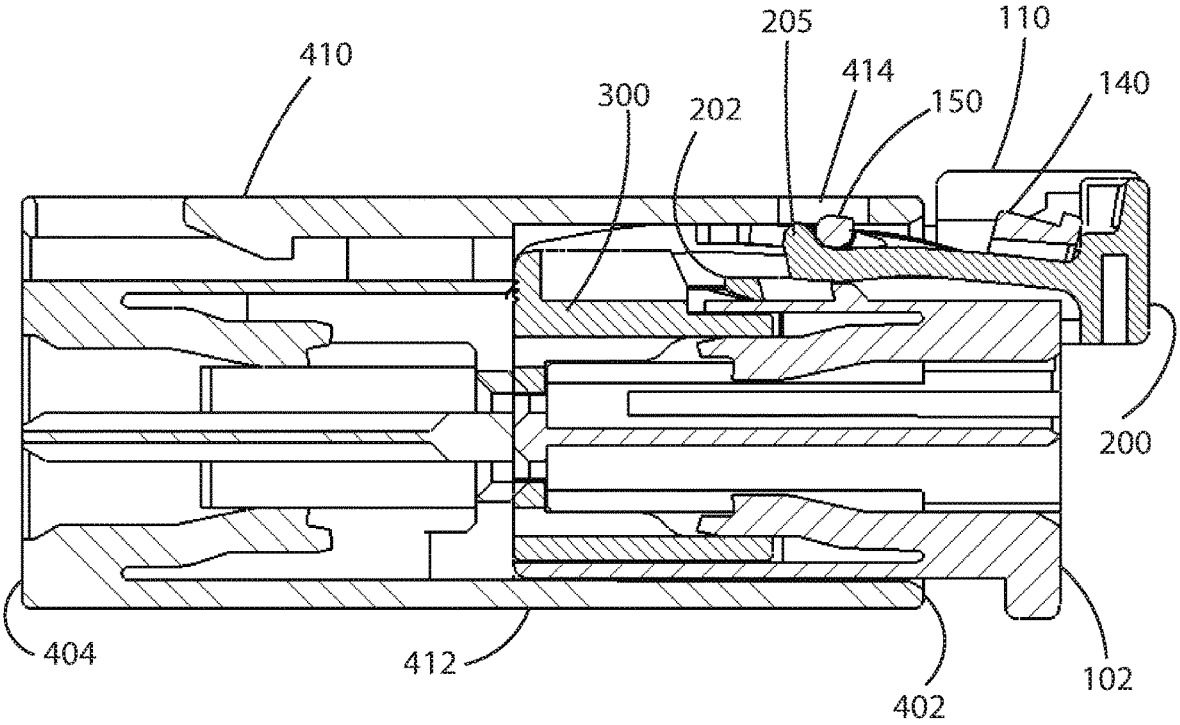
FIG. 10B is a cross-sectional view of the female housing and male housing of FIG. 10A, taken along line 10B-10B.
Figure 10C:
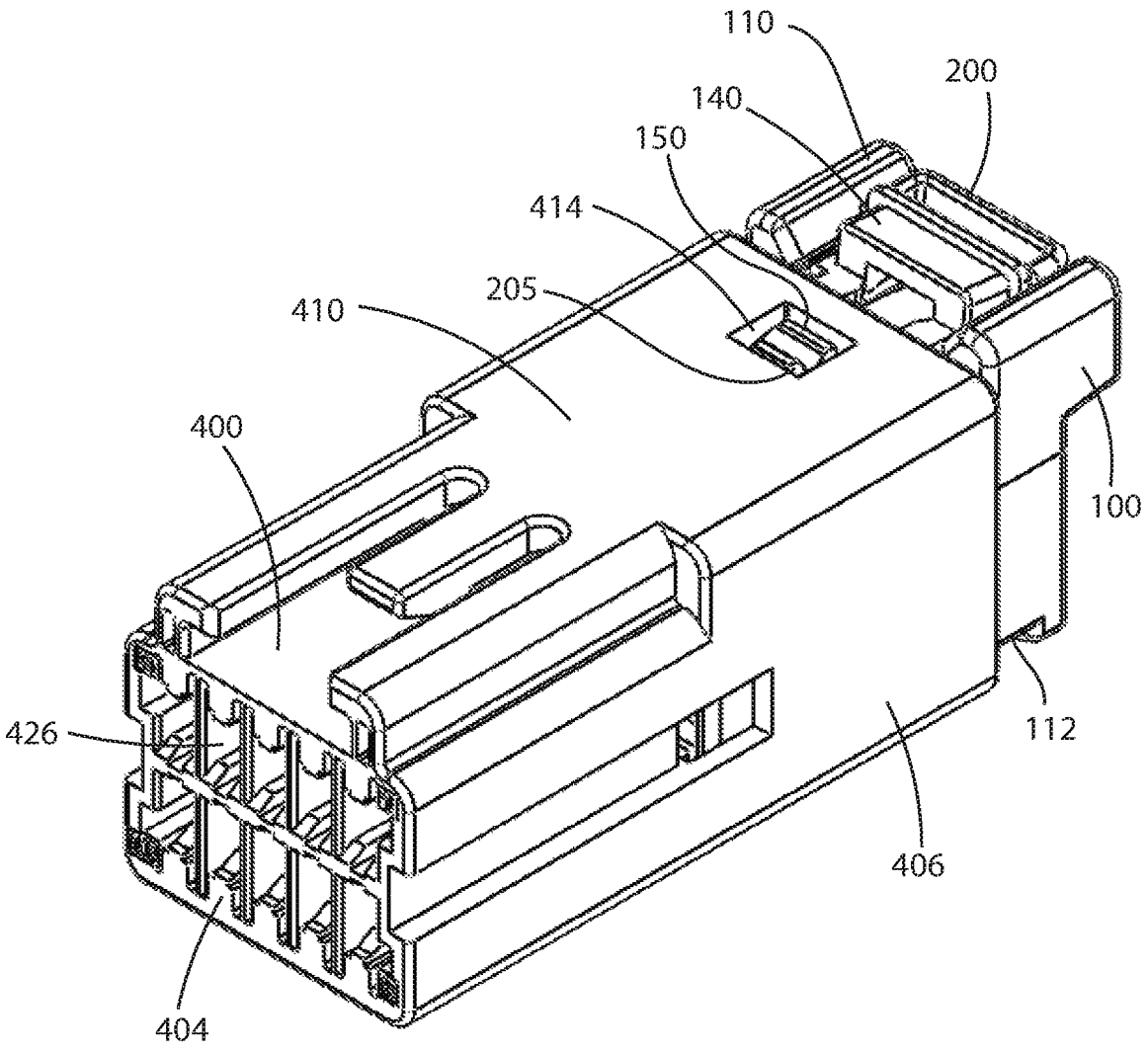
FIG. 10C is a perspective view of the female housing and male housing of FIG. 10A.

FIG. 10A is a rear end elevational view of the female housing of FIG. 1, with a male housing. FIG. 10B is a cross-sectional view of the female housing and male housing of FIG. 10A, taken along line 10B-10B. FIG. 10C is a perspective view of the female housing and male housing of FIG. 10A.

FIGS. 10A, 10B, and 10C show a male housing 400 which has a front end 402, a rear end 404, a first side 406, a top 410, a bottom 412, an aperture 414 in the top 410, and at least one terminal aperture 426 at the rear end 404.

As shown in FIGS. 10B and 10C, the front tip 205 of the CPA member 200 and the latch surface 150 of the female housing 100 are both shown in the aperture 414, and the latch surface 150 is disposed between the front tip 205 and the button 140. The aperture 414 enables a user to visibly confirm that the female housing 100, CPA member 200, and male housing 400 are in the fully locked position ("set" position).

Figure 11:
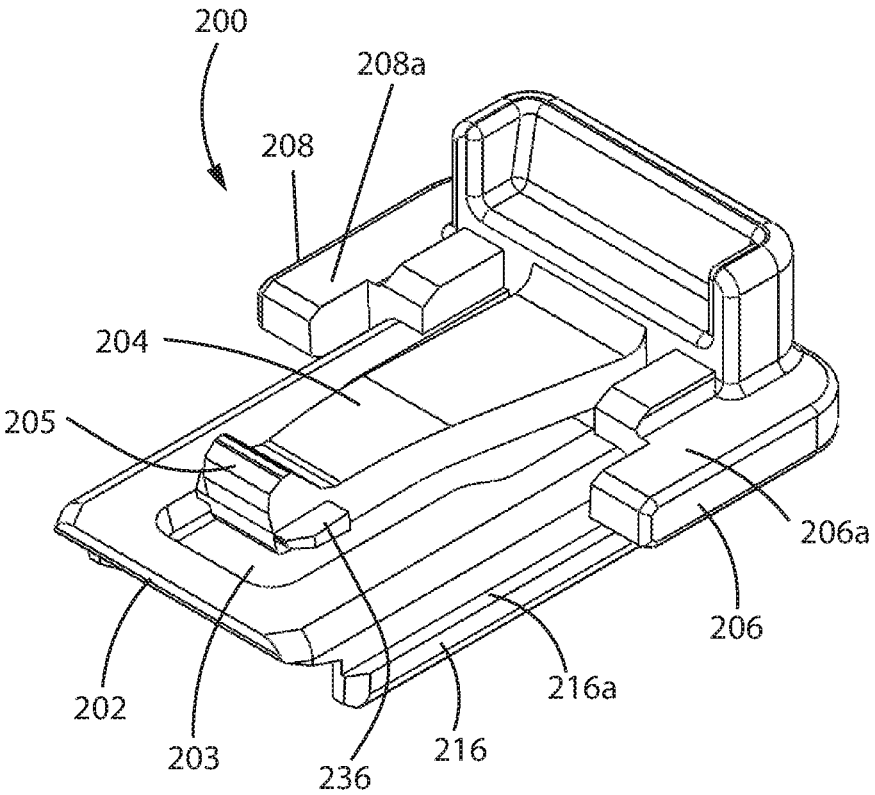
FIG. 11 is a perspective view of a CPA member, in accordance with the principles of the present invention.

FIG. 11 is a perspective view of a CPA member, in accordance with the principles of the present invention. FIG. 11 shows that a connector position assurance (CPA) member 200 has a front edge 202, a central aperture 203, a central beam 204, a front tip 205 on the central beam 204, an upper arm 206 on the first side of the CPA member 200, a lower arm 216 on the first side of the CPA member 200, and an upper arm 208 on the second side of the CPA member 200. The central aperture 203 provides space near the central beam 204, and permits the central beam 204 to move up and down.

As shown in FIG. 11, the upper arm 206 has an upper surface 206*a*. Also, the upper arm 208 has an upper surface 208*a*. The lower arm 216 has an upper surface 216*a*. The first side of the front tip 205 has a wing 236.

Figure 12:
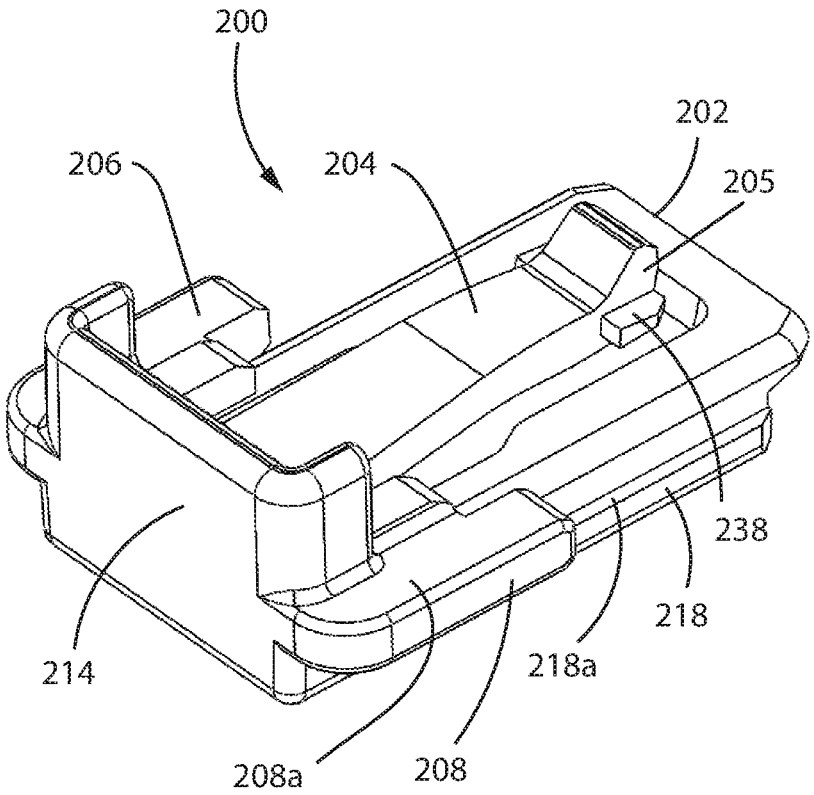
FIG. 12 is a perspective view of the CPA member of FIG. 11.

FIG. 12 is a perspective view of the CPA member of FIG. 11. FIG. 12 shows a rear upright portion 214 of the CPA member 200, a lower arm 218 on the second side of the CPA member 200, an upper surface 218*a* of the lower arm 218, and a wing 238 on the second side of the front tip 205.

Figure 13:
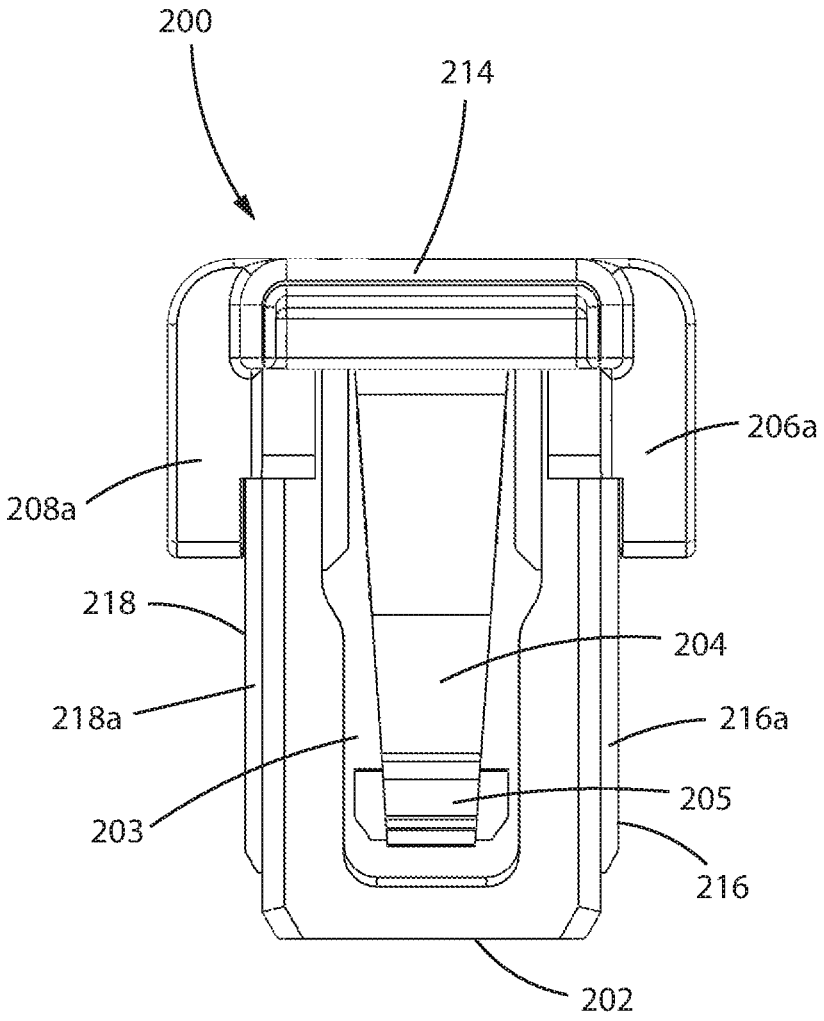
FIG. 13 is a top elevational view of the CPA member of FIG. 11.
Figure 14:
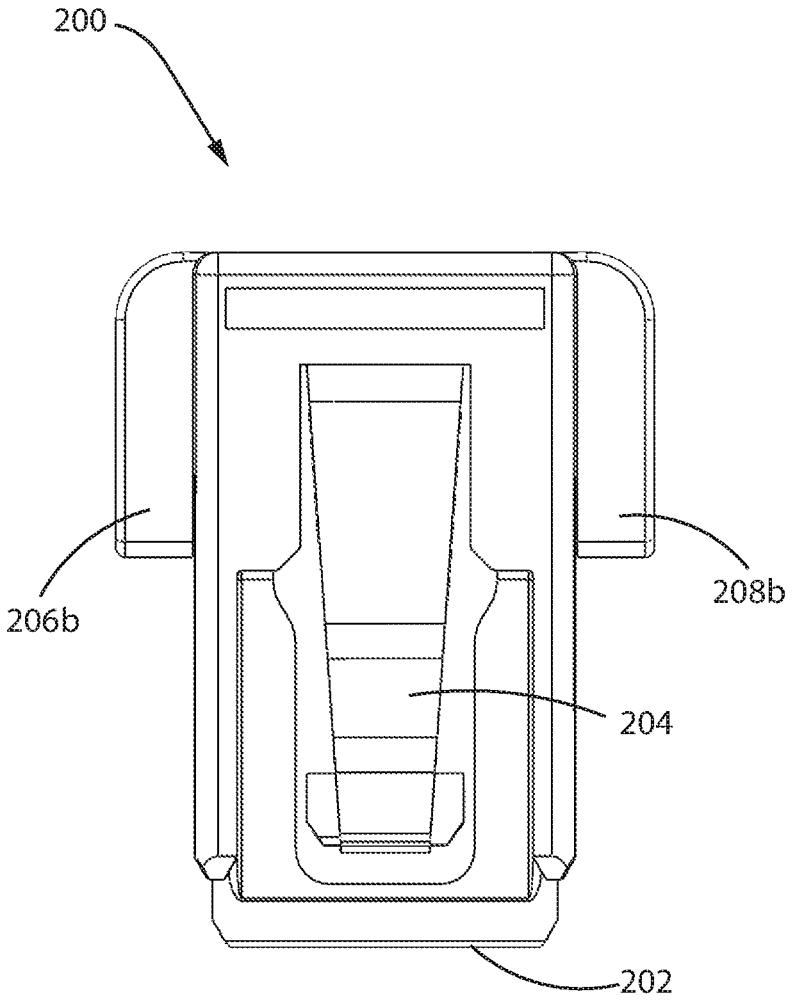
FIG. 14 is a bottom elevational view of the CPA member of FIG. 11.

FIG. 13 is a top elevational view of the CPA member of FIG. 11. FIG. 14 is a bottom elevational view of the CPA member of FIG. 11.

Figure 15:
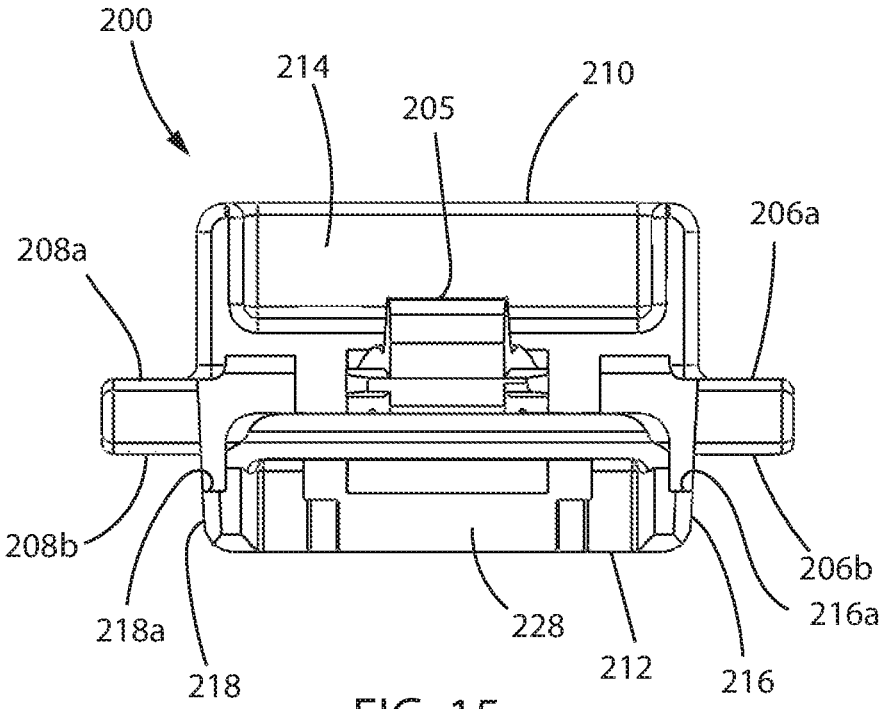
FIG. 15 is a front end elevational view of the CPA member of FIG. 11.

FIG. 15 is a front end elevational view of the CPA member of FIG. 11. FIG. 15 shows that the CPA member 200 of FIG. 11 forms a "T" shaped aperture 228. FIG. 15 also shows a lower surface 206*b* of the upper arm 206, a lower surface 208*b* of the upper arm 208, a top 210 of the CPA member 200, and a bottom 212 of the CPA member 200.

Figure 16:
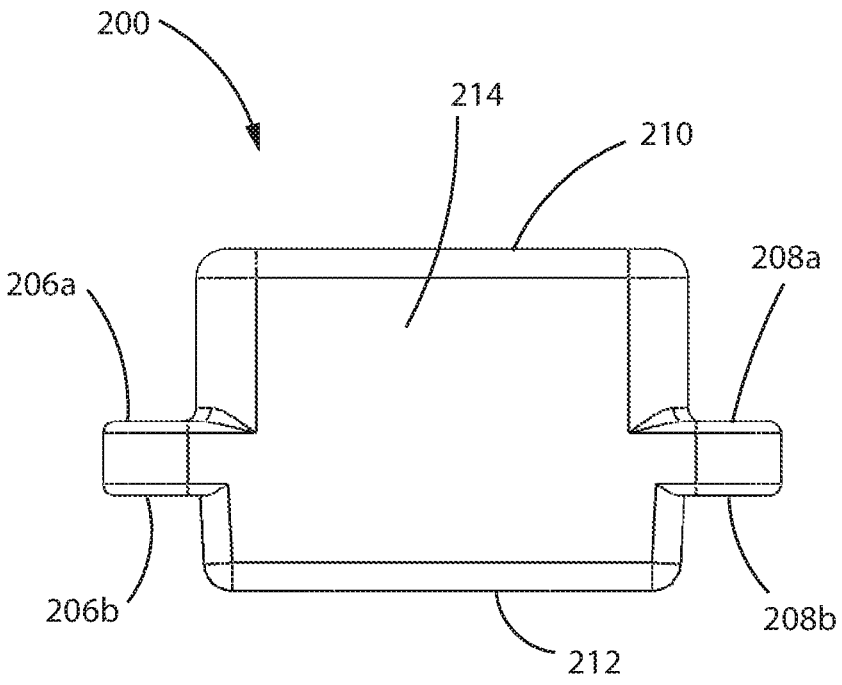
FIG. 16 is a rear end elevational view of the CPA member of FIG. 11.
Figure 17A:
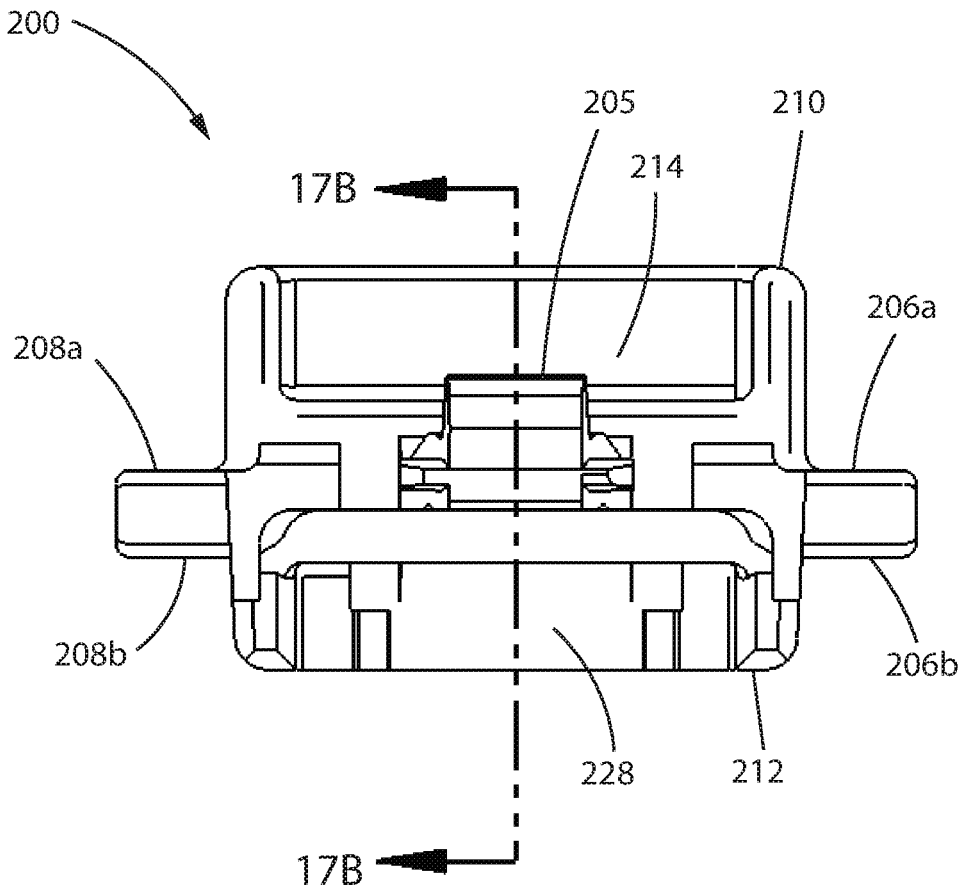
FIG. 17A is a front end elevational view of the CPA member of FIG. 11.
Figure 17B:
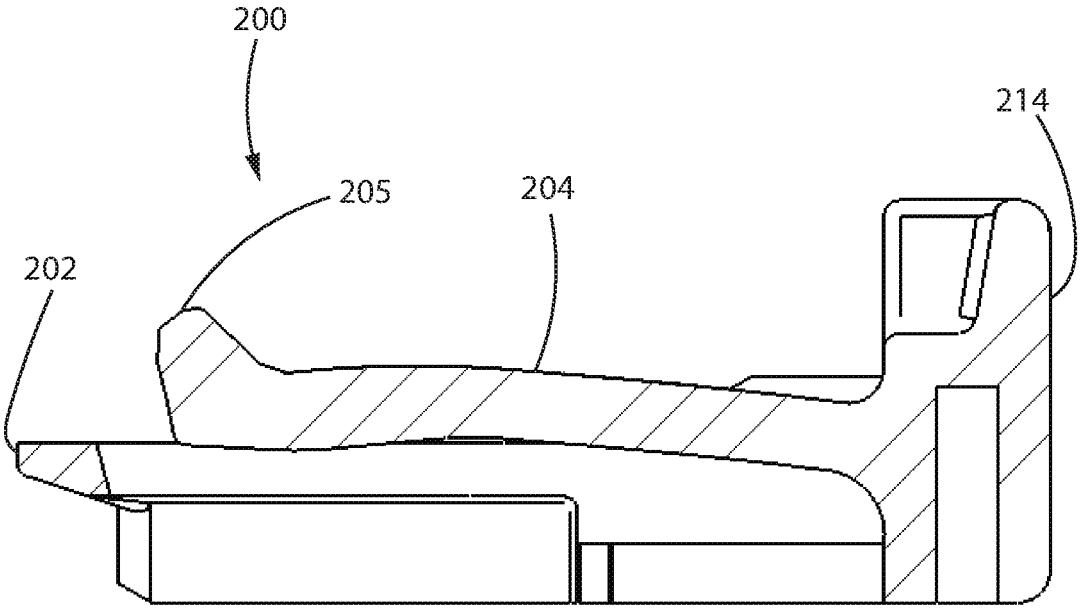
FIG. 17B is a cross-sectional view of the CPA member of FIG. 17A, taken along line 17B-17B.
Figure 18A:
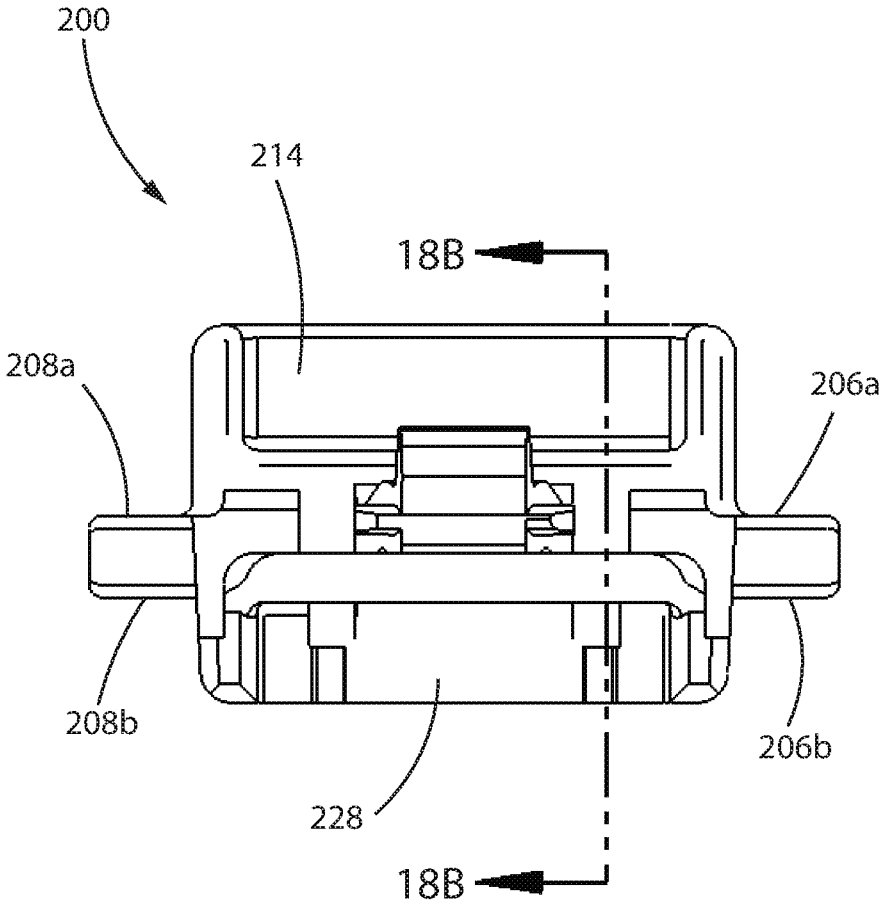
FIG. 18A is a front end elevational view of the CPA member of FIG. 11.
Figure 18B:
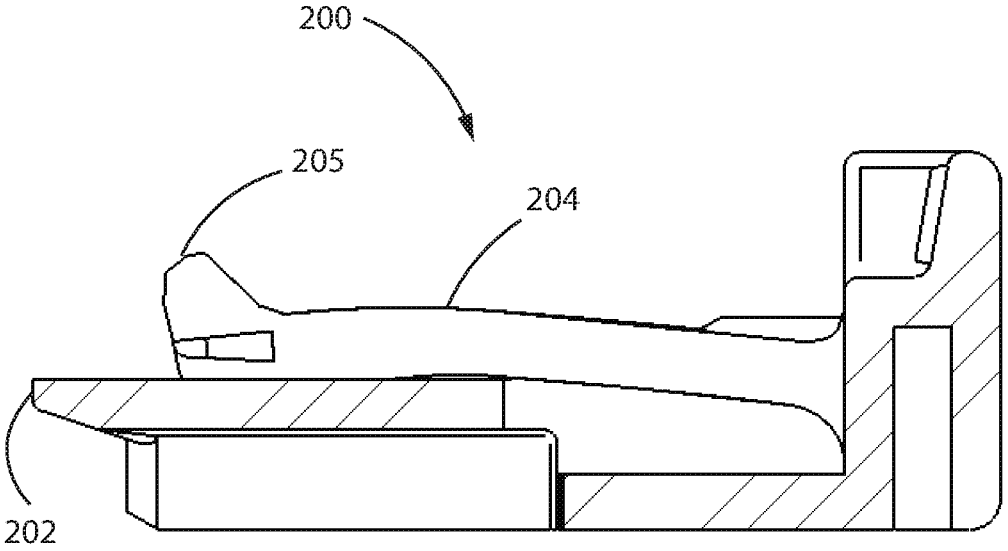
FIG. 18B is a cross-sectional view of the CPA member of FIG. 18A, taken along line 18B-18B.
Figure 19A:
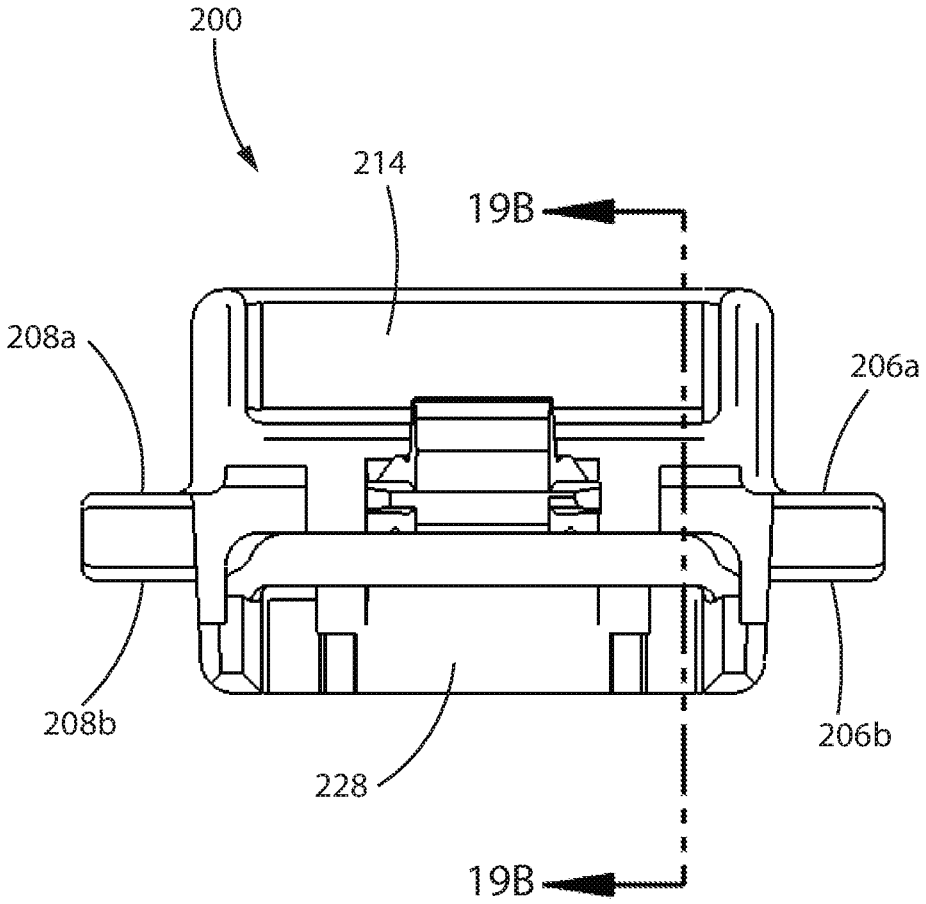
FIG. 19A is a front end elevational view of the CPA member of FIG. 11.
Figure 19B:
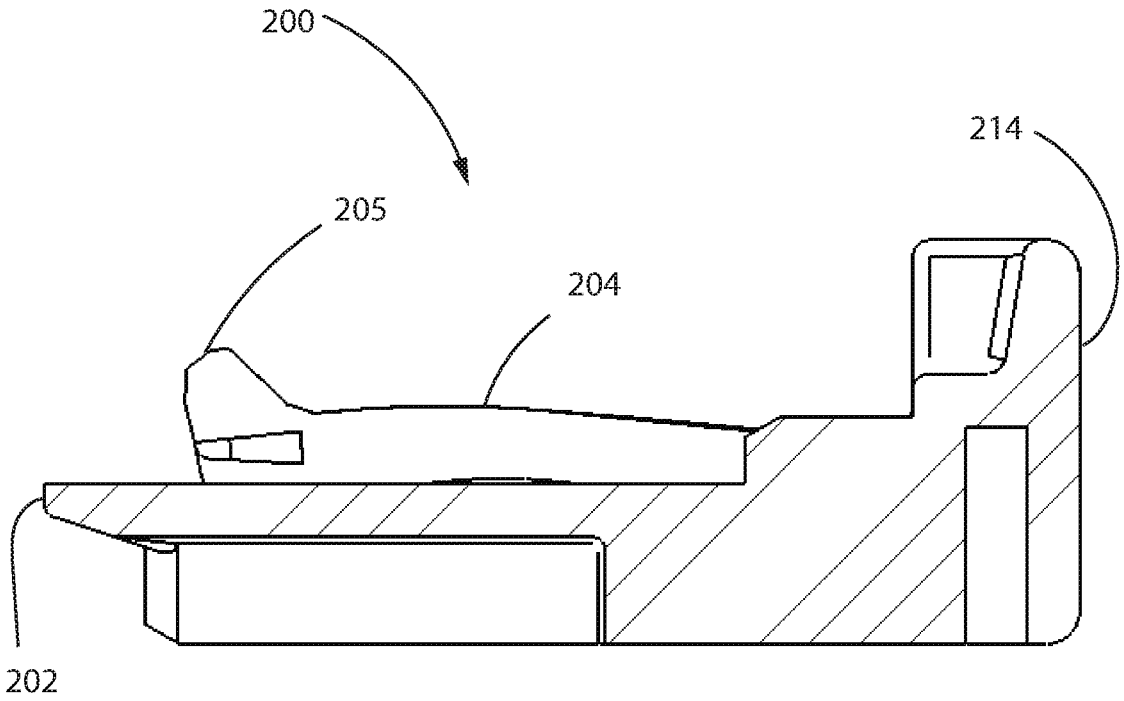
FIG. 19B is a cross-sectional view of the CPA member of FIG. 19A, taken along line 19B-19B.

FIG. 16 is a rear end elevational view of the CPA member of FIG. 11. FIG. 17A is a front end elevational view of the CPA member of FIG. 11. FIG. 17B is a cross-sectional view of the CPA member of FIG. 17A, taken along line 17B-17B. FIG. 18A is a front end elevational view of the CPA member of FIG. 11. FIG. 18B is a cross-sectional view of the CPA member of FIG. 18A, taken along line 18B-18B. FIG. 19A is a front end elevational view of the CPA member of FIG. 11. FIG. 19B is a cross-sectional view of the CPA member of FIG. 19A, taken along line 19B-19B.

The female housing 100 has a connector latch which latches with the male housing 400 to interlock. The CPA member 200 provides an assurance that both female and male housings are locked. Then, the CPA member 200 is pushed to the final lock position ("set" position).

The electrical connector with CPA of the present invention includes a number of advantages and improvements. The electrical connector with CPA of the present invention can help to prevent a locking latch from getting damaged/deformed during shipping and handling, and thus can help prevent mating problems.

The electrical connector with CPA of the present invention can help to prevent a CPA member from getting damaged/deformed during shipping and handling, and thus can help prevent mating problems.

The electrical connector with CPA of the present invention can help to prevent a user from needing to engage in secondary operations.

The electrical connector with CPA of the present invention can help to prevent complaints from a user, because it helps prevent problems associated with an inadvertent movement of a CPA member to a final lock position during shipping and/or handling, for example.

The electrical connector with CPA of the present invention provides an improved connector assembly comprising a female housing and CPA member designed to provide a superior audible click sound, moderate reinforcement, mutual retention, good mechanical strength when the female and male housings engage with each other, and extremely easy molding consideration by manufacturing the female housing's connector latch with overbuild and then pushing the button of the connector latch to a preset position during assembly.

The electrical connector with CPA of the present invention can help the CPA member 200 to stay in the preset position during shipping and handling.

The electrical connector with CPA of the present invention can prevent a need for a user to engage in a secondary operation such as trying to move a CPA member from a final lock position to a preset position, for example, after the CPA member was inadvertently moved into the final lock position during shipping and handling.

The electrical connector with CPA of the present invention can help prevent customer complaints, because it helps avoid snags with other cables.

The electrical connector with CPA of the present invention can help prevent a need for tray packaging.

As shown in FIG. 8B, when the CPA member 200 is in the preset position, the front edge 202 is on the left of the protrusion 122, and the front tip 205 is on the right of the latch surface 150.

As shown in the lower view of FIG. 9B, when the CPA member 200 is in the final lock position, the front edge 202 is in the position indicated and is spaced apart from the protrusion 122, and the front tip 205 is on the left side of the latch surface 150.

The CPA member 200 is not typically inserted into the front end 102 of the female housing 200 until after the female housing 200 is mated with the male housing 400. FIGS. 7-9B, for example, could potentially appear to depict a situation where the CPA member 200 is inserted into the front end 102 of the female housing 100 at a time when the female housing 100 is not yet mated with the male housing 400, and thus are for illustrative purposes only.

The alignment and mating of the CPA member 200 with the female housing 100 shall now be further described. FIG. 3 shows that the female housing 100 forms an upper aperture 130 near a first side 106 of the female housing 100. FIG. 11 shows that the CPA member 200 has an upper arm 206 on the first side of the CPA member 200.

When the CPA member 200 is inserted into the front end 102 of the female housing 100, while proceeding in a manner intended to arrive at the arrangement shown in FIG. 8B, the upper arm 206 enters into the upper aperture 130, the upper arm 208 enters into the upper aperture 134, the lower arm 216 enters into the lower aperture 132, and the lower arm 218 enters into the lower aperture 136. These features help to provide stability and secure fit.

At this time, the upper surface 206*a* of the upper arm 206 engages with, and is guided by, the upper wall 130*a* of the upper aperture 130. The lower surface 206*b* of the upper arm 206 engages with, and is guided by, the lower wall 130*b* of the upper aperture 130. The upper surface 208*a* of the upper arm 208 engages with, and is guided by, the upper wall 134*a* of the upper aperture 134. The lower surface 208*b* of the upper arm 208 engages with, and is guided by, the lower wall 134*b* of the upper aperture 134. These features help to provide stability and secure fit.

Also, at this time, at least one surface of the "T" shaped aperture 228 of the CPA member 200 engages with, and is guided by, at least one surface of the "T" shaped guide member 128 of the female housing 100. The "T" shaped aperture 228 of the CPA member 200 is shown in FIG. 17A, for example. The "T" shaped guide member 128 of the female housing 100 is shown in FIGS. 3 and 4, for example. These features help to provide stability and secure fit.

Additionally, at this time, the upper surface 216*a* of the lower arm 216 engages with, and is guided by, a surface of the female housing 100, and also the upper surface 218*a* of the lower arm 218 engages with, and is guided by, a surface of the female housing 100. These features help to provide stability and secure fit.

The wing 236 engages with a lower surface of the latch beam 146. The wing 238 engages with a lower surface of the latch beam 148. The wings 236 and 238 prevent the front tip 205 from going up over the latch surface 150.

The front tip 205 is designed to go under the latch surface 150 when the CPA member 200 is moved from the preset position (shown in FIG. 8B) to the set position (shown in FIG. 9B).

The front tip 205 is designed to engage the right side of the latch surface 150, as shown in FIG. 8B, when the CPA member 200 is in the preset position. That is, after the CPA member 200 has been inserted forward into the female housing 100, the front tip 205 is designed to be blocked from easy further forward movement into the female housing 100, as shown in FIG. 8B, when the CPA member 200 is in the preset position.

The front tip 205 is designed to engage the left side of the latch surface 150, as shown in FIG. 9B, when the CPA member 200 is in the set position. That is, after the CPA member 200 has been inserted forward into the female housing 100, the front tip 205 is designed to be blocked from easy backward movement out from the female housing 100, as shown in FIG. 8B, when the CPA member 200 is in the set position.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

LIST OF REFERENCE NUMERALS

100 Female housing
102 Front end of female housing 100
104 Rear end of female housing 100
106 First side of female housing 100
108 Second side of female housing 100
110 Top of female housing 100
112 Bottom of female housing 100
114 Terminal aperture on front end 102
122 Protrusion on interior of female housing 100
126 Terminal aperture on rear end 104
128 "T" shaped guide member on female housing 100
130 Upper aperture near first side 106, for receiving upper arm 206
130*a* Upper wall of upper aperture 130
130*b* Lower wall of upper aperture 130
132 Lower aperture near first side 106, for receiving lower arm 216
132*a* Upper wall of lower aperture 132
132*b* Lower wall of lower aperture 132
134 Upper aperture near second side 108, for receiving upper arm 208
134*a* Upper wall of upper aperture 134
134*b* Lower wall of upper aperture 134
136 Lower aperture near second side 108, for receiving lower arm 218
136*a* Upper wall of lower aperture 136
136*b* Lower wall of lower aperture 136
140 Button of connector latch, on female housing 100
146 First latch beam of connector latch, on female housing 100
148 Second latch beam of connector latch, on female housing 100
150 Latch surface of connector latch, on female housing 100
200 CPA member
202 Front edge of CPA member 200
203 Central aperture formed by CPA member 200
204 Central beam of CPA member 200
205 Front tip of central beam 204
206 Upper arm on first side of CPA member 200
206*a* Upper surface of upper arm 206
206*b* Lower surface of upper arm 206
208 Upper arm on second side of CPA member 200
208*a* Upper surface of upper arm 208
208*b* Lower surface of upper arm 208
210 Top of CPA member 200
212 Bottom of CPA member 200
214 Rear upright portion of CPA member 200
216 Lower arm on first side of CPA member 200
216*a* Upper surface of lower arm 216
218 Lower arm on second side of CPA member 200
218*a* Upper surface of lower arm 218
228 "T" shaped aperture formed by CPA member 200
236 Wing on first side of front tip 205
238 Wing on second side of front tip 205
300 TPA member
400 Male housing
402 Front end of male housing 400
404 Rear end of male housing 400
406 First side of male housing 400
410 Top of male housing 400
412 Bottom of male housing 400
414 Aperture formed in top of male housing 400
426 Terminal aperture on rear end 404

We claim:

1. A connector, comprising:

a first housing forming at least a first aperture and a connector latch, and a connector position assurance member having first arm; a front edge, and a front tip, wherein the first arm is configured to be received by the first aperture, the front tip is configured to engage with the connector latch, and an opening is formed behind the front edge of the connector position assurance member.

2. The connector of claim 1, wherein the first aperture corresponds to a first upper aperture, the first housing forms a first lower aperture, a second upper aperture, a second lower aperture, the connector position assurance member has a first upper arm, a first lower arm, a second upper arm, and a second lower arm, the first upper arm is configured to be received by the first upper aperture, the first lower arm is configured to be received by the first lower aperture, the second upper arm is configured to be received by the second upper aperture, and the second lower arm is configured to be received b the second lower aperture.

3. The connector of claim 2, wherein the first upper arm has a first surface, the first upper aperture has a first surface, and the first surface of the first upper arm is configured to engage with the first surface of the first upper aperture.

4. The connector of claim 3, wherein the first housing has a "T" shaped guide member, the connector position assurance member forms a "T" shaped aperture, and the "T" shaped guide member is configured to be received by the "T" shaped aperture.

5. The connector of claim 4, wherein the first housing forms a protrusion, and the front edge is configured to engage with the protrusion when the connector position assurance member is in a preset position.

6. The connector of claim 5, wherein the connector latch has a latch surface, the front tip is configured to engage with the latch surface when the connector position assurance member is in the preset position.

7. The connector of claim 6, wherein the front tip is configured to engage with a first side of the latch surface when the connector position assurance member is in the preset position, and the front tip is configured to engage with a second side of the latch surface when the connector position assurance member is in a set position.

8. The connector of claim 7, wherein the front edge is spaced apart from the protrusion when the connector position assurance member is in the set position.

9. The connector of claim 8, further comprising:

a second housing having at least a front end and a top, wherein a first aperture is formed at the front end of the second housing, a second aperture is formed at the top of the second housing, the first aperture of the second housing is configured to receive the first housing, and the front tip and latch surface are configured to be at the second aperture of the second housing when the connector position assurance member is in the set position.

10. A method of coupling first housing with a member, comprising:

receiving a first arm of a member into a first aperture of a first housing;

engaging a front edge of the member with a protrusion of the first housing; and engaging a front tip of the member with a connector latch of the first housing wherein an opening is formed behind the front edge of the member.

11. The method of claim 10, further comprising:

receiving a first upper arm into a first upper aperture, wherein the first arm corresponds to the first upper arm and the first aperture corresponds to the first upper aperture, receiving a first lower arm into a first lower aperture, wherein the member has the first lower arm and the first housing forms the first lower aperture, receiving a second upper arm into a second upper aperture, wherein the member has the second upper arm and the first housing forms the second upper aperture, and receiving a second lower arm into a second lower aperture, wherein the member has the second lower arm and the first housing forms the second lower aperture.

12. The method of claim 10, further comprising:

engaging a first surface of the first arm and a first surface of the first aperture.

13. The method of claim 10, further comprising:

receiving a "T" shaped guide member of the first housing into a "T" shaped aperture formed by the member.

14. The method of claim 10, wherein the member is in a preset position when the front edge of the member engages with the protrusion of the first housing.

15. The method of claim 10, further comprising:

receiving an end of the first housing into a first aperture formed by a second housing; and arranging the front tip and connector latch to be at a second aperture formed by the second housing.

16. A connector, comprising:

a housing forming at least an aperture and a connector latch; and a member having a front tip, wherein the member is configured to be received in the aperture, the front tip is configured to engage with the connector latch, and an opening is formed below the front tip of the member.

17. The connector of claim 16, wherein the housing has a protrusion, the member has a front edge, and the front edge engages with the protrusion when the member is in a preset position.

18. The connector of claim 17, wherein the front edge is spaced apart from the protrusion when the member is in a set position.

19. The connector of claim 16, wherein the front tip is configured to engage with a first side of the connector latch when the member is in a preset position, and the front tip is configured to engage with a second side of the connector latch when the member is in a set position.

20. The connector of claim 16, wherein the housing has a "T" shaped guide member, the member forms a "T" shaped aperture, and the "T" shaped guide member is configured to be received by the "T" shaped aperture.

* * * * *